US009594331B2

(12) United States Patent
Suiseki et al.

(10) Patent No.: US 9,594,331 B2
(45) Date of Patent: Mar. 14, 2017

(54) POWDER CONTAINER AND IMAGE FORMING APPARATUS INCORPORATING SAME

(71) Applicants: Mai Suiseki, Shizuoka (JP); Yuuta Tanaka, Shizuoka (JP)

(72) Inventors: Mai Suiseki, Shizuoka (JP); Yuuta Tanaka, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/055,957

(22) Filed: Feb. 29, 2016

(65) Prior Publication Data

US 2016/0252846 A1 Sep. 1, 2016

(30) Foreign Application Priority Data

Feb. 27, 2015 (JP) ..... 2015-038253
Feb. 17, 2016 (JP) ..... 2016-027989

(51) Int. Cl.
*G03G 15/08* (2006.01)

(52) U.S. Cl.
CPC ..... *G03G 15/0886* (2013.01)

(58) Field of Classification Search
CPC ..... G03G 15/0886; G03G 15/0872; G03G 2215/067; G03G 2215/0678
See application file for complete search history.

(56) References Cited

U.S. PATENT DOCUMENTS 6,678,492 B1 1/2004 Terazawa et al.
2004/0265012 A1* 12/2004 Hasebe ..... G03G 15/0886 399/260
2007/0154244 A1 7/2007 Taguchi et al.
2010/0296847 A1 11/2010 Kurenuma et al.
2011/0020039 A1 1/2011 Mitsuishi et al.
2013/0330105 A1* 12/2013 Komatsu ..... G03G 15/0832 399/262
2014/0029973 A1 1/2014 Terazawa et al.
(Continued)

FOREIGN PATENT DOCUMENTS

JP 60-003856 1/1985
JP 2004-139034 5/2004
(Continued)

OTHER PUBLICATIONS

U.S. Appl. No. 14/832,181, filed Aug. 21, 2015.

*Primary Examiner* — Sandra Brase
(74) *Attorney, Agent, or Firm* — Oblon, McClelland, Maier & Neustadt, L.L.P.

(57) ABSTRACT

A powder container includes a container body to contain a powder for use in image formation and a nozzle receiver disposed on one longitudinal end side of the container body. The nozzle receiver includes a shutter having a nozzle insertion opening, into which a conveying nozzle to convey the powder from an inside to an outside of the container body is inserted, and a shutter holder including an inclined face and an opening to communicate with a nozzle opening of the conveying nozzle. The inclined face guides the shutter to rotate around an axis of the conveying nozzle, and the shutter moves between an open position to open the opening of the shutter holder and a closed position to close the opening of the shutter holder in accordance with insertion and removal of the conveying nozzle into the nozzle insertion opening.

16 Claims, 17 Drawing Sheets

(56) References Cited

U.S. PATENT DOCUMENTS

| | | | | |
|---|---|---|---|---|
| 2014/0241757 | A1 | 8/2014 | Kikuchi et al. | |
| 2014/0270859 | A1 | 9/2014 | Hosokawa et al. | |
| 2014/0348545 | A1* | 11/2014 | Shiba ..... | G03G 15/0872 399/258 |
| 2014/0348551 | A1 | 11/2014 | Yamabe et al. | |
| 2015/0147096 | A1 | 5/2015 | Hori et al. | |
| 2016/0033898 | A1 | 2/2016 | Yamabe et al. | |

FOREIGN PATENT DOCUMENTS

| | | |
|---|---|---|
| JP | 2013-113945 | 6/2013 |
| JP | 2014-164107 | 9/2014 |

* cited by examiner

POWDER CONTAINER AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2015-038253 filed on Feb. 27, 2015 and 2016-027989 filed on Feb. 17, 2016, in the Japan Patent Office, the entire disclosure of which is hereby incorporated by reference herein.

BACKGROUND

Technical Field

Embodiments of the present invention generally relate to a powder container to contain a powder used for image formation and an image forming apparatus that incorporates the powder container.

Description of the Related Art

In electrophotographic image forming apparatuses, such as printers, facsimile machines, copiers, or multifunction peripherals having at least two of copying, printing, plotting, scanning, and facsimile transmission capabilities, a powder conveying device supplies (replenishes) toner (i.e., developer or powder) from a toner container serving as a powder container to a developing device.

SUMMARY

An embodiment of the present invention provides a powder container that includes a container body to contain a powder for use in image formation and a nozzle receiver disposed on one longitudinal end side of the container body. The nozzle receiver includes a shutter and a shutter holder to hold the shutter. The shutter has a nozzle insertion opening into which a conveying nozzle is inserted. The conveying nozzle conveys the powder from an inside to an outside of the container body. The shutter holder includes an inclined face and an opening to communicate with a nozzle opening of the conveying nozzle. With the inclined face, the shutter is guided to rotate around an axis of the conveying nozzle extending in a direction in which the conveying nozzle is inserted. The shutter moves between an open position to open the opening of the shutter holder and a closed position to close the opening of the shutter holder in accordance with insertion and removal of the conveying nozzle into the nozzle insertion opening.

In another embodiment, a powder container includes a container body to contain a powder for use in image formation and a nozzle receiver disposed on one longitudinal end side of the container body. The nozzle receiver includes a shutter holder including a nozzle insertion opening into which a conveying nozzle is inserted. The conveying nozzle conveys the powder from an inside to an outside of the container body. The nozzle receiver further includes a shutter to close the nozzle insertion opening and secured to the shutter holder via a support point rotatably around the support point. The shutter rotates between an open position to open the nozzle insertion opening and a closed position to close the nozzle insertion opening in accordance with insertion and removal of the conveying nozzle into the nozzle insertion opening.

In yet another embodiment, an image forming apparatus includes the powder container described above.

In yet another embodiment, an image forming apparatus includes a container holding section and a powder conveying device. The container holding section removably holds the above-described powder container, and the powder conveying device includes the conveying nozzle to fit in the nozzle insertion opening of the powder container.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
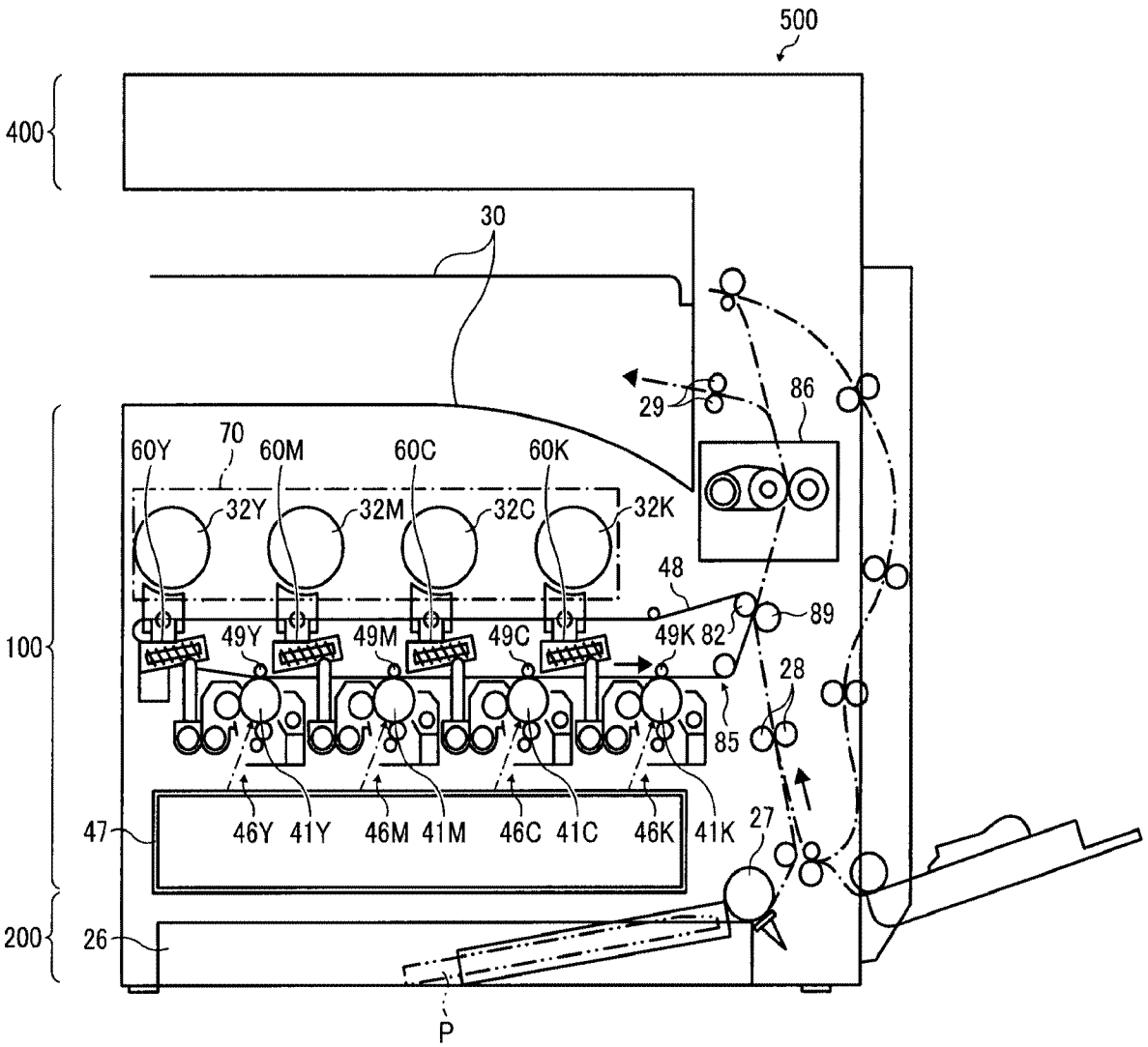
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to a first embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 is a schematic diagram illustrating an overall configuration of an electrophotographic tandem-type color copier (hereinafter, referred to as "a copier 500") serving as an image forming apparatus according to an embodiment. For example, the copier 500 can be a monochrome copier. Image forming apparatuses according to the present embodiment are not limited to copiers but can be printers, facsimile machines, or multifunction peripherals having at least two capabilities of copying, printing, facsimile transmission, scanning. The copier 500 includes a copier body (or a printer 100), a sheet-feeding table or sheet feeder 200, and a scanner section (or a scanner 400 mounted in the printer 100.

The printer 100 includes four image forming sections 46Y, 46M, 46C, and 46K disposed side by side, facing an intermediate transfer belt 48.

Four toner containers 32Y, 32M, 32C, and 32K serving as powder containers corresponding to different colors (yellow, magenta, cyan, and black) are detachably (replaceably) attached to a toner container holder 70 serving as a container holding section disposed in an upper part of the printer 100. The toner containers 32Y, 32M, 32C, and 32K contain yellow, magenta, cyan, and black toners, respectively.

An intermediate transfer device 85 is disposed below the toner container holder 70. The intermediate transfer device 85 includes an intermediate transfer belt 48, primary-transfer bias rollers 49Y, 49M, 49C, and 49K, a secondary-transfer backup roller 82, multiple rollers, an intermediate-transfer cleaning device, and the like. The intermediate transfer belt 48 is supported by the multiple rollers including the secondary-transfer backup roller 82 and is rotated in the direction indicated by an arrow illustrated in FIG. 1 as the secondary-transfer backup roller 82 rotates.

Four toner replenishing devices 60Y, 60M, 60C, and 60K serving as powder replenishing (supply) devices corresponding to the four toner containers 32Y, 32M, 32C, and 32K of the four colors are disposed below the toner containers 32Y, 32M, 32C, and 32K, respectively. Each toner replenishing device 60 supplies toner from the corresponding toner container 32 to a developing device of the corresponding image forming section 46 (i.e., an image forming unit).

As illustrated in FIG. 1, an exposing device 47, serving as a latent image forming device, is disposed below the four image forming sections 46Y, 46M, 46C, and 46K. The exposing device 47 exposes and scans the surfaces of photoconductors 41Y, 41M, 41C, and 41K serving as image bearers (to be described later) with light according to image data of a document image read by the scanner 400, thereby forming electrostatic latent images on the surfaces of the photoconductors 41Y, 41M, 41C, and 41K. The image data can be input from an external apparatus, such as a personal computer, connected to the copier 500, instead of being read by the scanner 400. Although the exposing device 47 in the configuration illustrated in FIG. 1 employs laser beam scanning using a laser diode, other configurations such as those using light-emitting diode (LED) arrays may be used.

Figure 2:
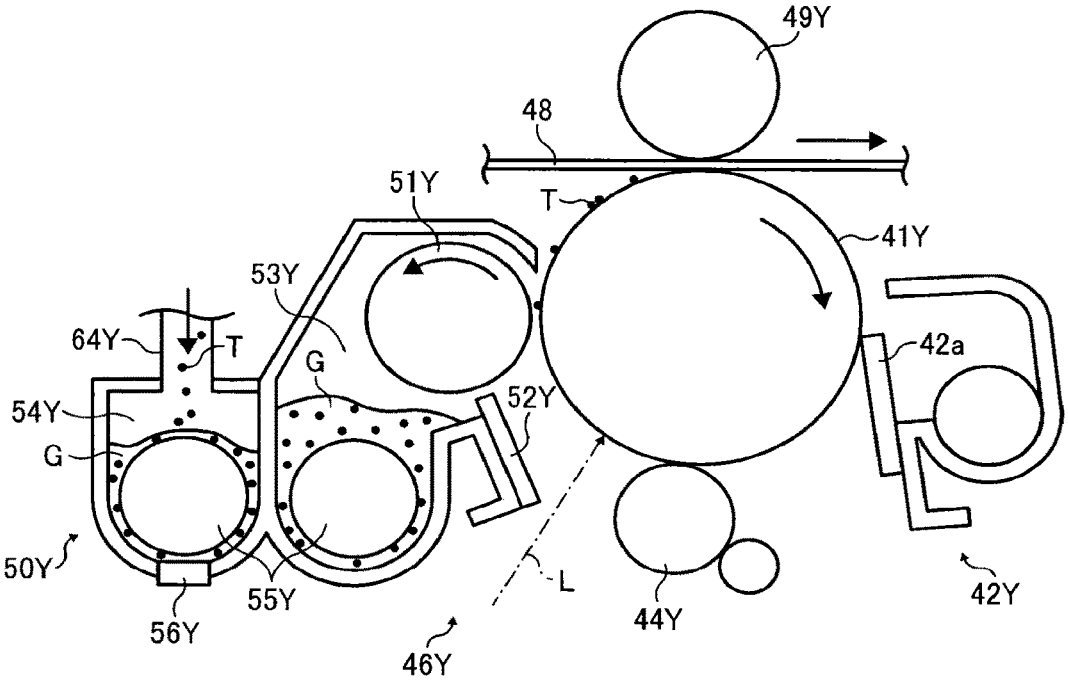
FIG. 2 is a schematic diagram illustrating an image forming section included in the image forming apparatus illustrated in FIG. 1.

FIG. 2 is a schematic end-on axial view of the image forming section 46Y for yellow.

The image forming section 46Y includes the drum-shaped photoconductor 41Y. Around the photoconductor 41Y, a charging roller 44Y serving as a charging device, a developing device 50Y, a cleaning device 42Y to clean the photoconductor 41Y, and a discharger are disposed. Image forming processes, namely, charging, exposure, development, transfer, and cleaning processes are performed on the photoconductor 41Y, and thus a yellow toner image is formed on the photoconductor 41Y.

It is to be noted that other image forming sections 46M, 46C, and 46K have a similar configuration to that of the yellow image forming section 46Y except the color of the toner used therein and form magenta, cyan, and black toner images, respectively. Thus, only the image forming section 46Y is described below and descriptions of other image forming sections 46M, 46C, and 46K are omitted.

Referring to FIG. 2, the photoconductor 41Y is rotated clockwise in FIG. 2 as indicated by an arrow by a driving motor. The surface of the photoconductor 41Y is charged uniformly at a position facing the charging roller 44Y by the charging roller 44Y (charging process). When the photoconductor 41Y reaches a position to receive a laser beam L emitted from an exposing device 47, the photoconductor 41Y is scanned with the laser beam L, and thus an electrostatic latent image for yellow is formed thereon (exposure process). Specifically, the exposing device 47 includes light sources to emit the laser beam L, multiple optical elements, and a polygon mirror that is rotated by a motor. The exposing device 47 directs the laser beam L to the photoconductor 41 via the multiple optical elements while deflecting the laser beam L with the polygon mirror. Then, the photoconductor 41Y reaches a position facing the developing device 50Y, where the latent image is developed with toner into a yellow toner image (development process).

The primary-transfer bias roller 49Y sandwiches the intermediate transfer belt 48 with the photoconductor 41Y, and a nip therebetween is called a primary transfer nip. The primary-transfer bias roller 49Y receives a transfer bias whose polarity is opposite the charge polarity of toner.

At the position facing the primary-transfer bias roller 49Y via the intermediate transfer belt 48, the toner image is transferred from the photoconductor 41Y onto the intermediate transfer belt 48 (primary transfer process). After the primary transfer process, a certain amount of toner tends to remain untransferred on the photoconductor 41Y. Subsequently, the surface of the photoconductor 41Y reaches a position facing the cleaning device 42Y, where a cleaning blade 42*a* of the cleaning device 42Y mechanically scraps off the untransferred toner from the photoconductor 41Y (cleaning process). Subsequently, the discharger removes residual potentials from the surface of the photoconductor 41Y. Thus, a sequence of image forming processes performed on the photoconductor 41Y is completed.

The above-described image forming processes are performed also in the image forming sections 46M, 46C, and 46K similarly. That is, the exposing device 47 disposed below the image forming sections 46M, 46C, and 46K in FIG. 1 directs the laser beams L according to image data onto the photoconductors 41M, 41C, and 41K of the image forming sections 46M, 41C, and 41K.

Subsequently, respective color latent images on the photoconductors 41M, 41C, and 41K are developed into toner images and transferred to the intermediate transfer belt 48 due to the action of transfer biases applied to the respective primary-transfer bias rollers 49 at the primary transfer nips, where the intermediate transfer belt 48 is nipped between the primary-transfer bias rollers 49M, 49C, and 49K and the photoconductors 41M, 41C, and 41K.

While rotating in the direction indicated by the arrow illustrated in FIG. 1, the intermediate transfer belt 48 sequentially passes through the primary transfer nips facing the primary-transfer bias rollers 49Y, 49M, 49C, and 49K. Then, the single-color toner images are transferred from the respective photoconductors 41Y, 41M, 41C, and 41K primarily and superimposed one on another, as a multicolor toner, on the intermediate transfer belt 48.

Then, the intermediate transfer belt 48 carrying the multicolor toner image reaches a position facing a secondary transfer roller 89 disposed facing the secondary-transfer backup roller 82. The secondary-transfer backup roller 82 and the secondary transfer roller 89 press against each other via the intermediate transfer belt 48, and the contact portion therebetween is hereinafter referred to as a secondary transfer nip. The multicolor toner image on the intermediate transfer belt 48 is transferred to a recording medium P, such as a sheet of paper, conveyed to the secondary transfer nip, due to the action of a transfer bias applied to the secondary-transfer backup roller 82, for example. At this time, a certain amount of toner tends to remain on the intermediate transfer belt 48 after the secondary transfer process. The belt cleaning unit collects untransferred toner remaining on the intermediate transfer belt 48, and thus a sequence of transfer processes performed on the intermediate transfer belt 48 is completed.

Next, sheet conveyance is described below.

The recording medium P is transported by a feed tray 26 of the sheet feeder 200 positioned below the printer 100 to the secondary transfer nip via a feed roller 27 and a registration roller pair 28. More specifically, the feed tray 26 contains multiple recording media P piled one on another. The feed roller 27 rotates counterclockwise in FIG. 1 to feed the recording medium P on the top in the feed tray 26 toward a nip formed by the registration roller pair 28.

The registration roller pair 28 stops rotating temporarily, stopping the recording medium P with a leading edge of the recording medium P stuck in the nip. The registration roller pair 28 resumes rotation to transport the recording medium P to the secondary transfer nip, timed to coincide with the arrival of the multicolor toner image formed on the intermediate transfer belt 48. Thus, the multicolor toner image is recorded on the recording medium P.

Subsequently, the recording medium P is transported to the fixing device 86. In the fixing device 86, a fixing belt and a pressing roller apply heat and pressure to the recording medium P to fix the multicolor toner image on the recording medium P. Subsequently, the recording medium P is discharged by a discharge roller pair 29 outside the apparatus. The recording media P are sequentially stacked as output images on a stack tray 30. Thus, a sequence of image forming processes performed in the copier 500 is completed.

Next, a configuration and operation of the developing device 50Y in the image forming section 46Y are described in further detail below with reference to FIG. 2. The image forming sections 46 for other colors are configured similarly, and thus descriptions thereof are omitted.

As illustrated in FIG. 2, the developing device 50Y includes a developing roller 51Y serving as a developer bearer, a doctor blade 52Y serving as a developer regulating plate, two developer conveying screws 55Y, a toner density sensor 56Y, and the like. The developing roller 51Y faces the photoconductor 41Y, and the doctor blade 52Y faces the developing roller 51Y. The two developer conveying screws 55Y are disposed inside two developer accommodating sections, i.e., first and second developer accommodating sections 53Y and 54Y. The developing roller 51Y includes a stationary magnet roller (or multiple magnets), a sleeve that rotates around the magnet roller, and the like. The first and second developer accommodating sections 53Y and 54Y contain two-component developer G including carrier (carrier particles) and toner (toner particles). In the developer accommodating section 53Y, the developing roller 51Y is disposed. The second developer accommodating section 54Y communicates with a toner dropping passage 64Y via an opening disposed in the upper side thereof. For example, the toner dropping passage 64Y is a conduit, a tube, or a pipe, and the shape is not limited to circle. The toner density sensor 56Y detects a toner density (or percentage of toner) in the developer G stored in the second developer accommodating section 54Y.

The developer G in the developing device 50 circulates between the first developer accommodating section 53Y and the second developer accommodating section 54Y while being stirred by the two developer conveying screws 55Y. While being transported by the developer conveying screw 55Y, the developer G in the first developer accommodating section 53Y, in which the developing roller 51Y is disposed, is attracted by magnetic fields generated by the magnet roller inside the developing roller 51Y and carried onto the sleeve surface of the developing roller 51Y. The developer G carried on the developing roller 51Y moves in the circumferential direction (arc-shaped direction) of the developing roller 51Y as the sleeve of the developing roller 51Y rotates counterclockwise in FIG. 2 as indicated by an arrow in FIG. 2. At that time, the toner T in developer G is charged through friction with carrier particles to have a potential in the polarity opposite the polarity of the carrier. Then, the toner T is attracted to the developing roller 51Y together with the carrier attracted by the magnetic field generated on the developing roller 51Y.

The developer G carried on the developing roller 51Y is transported as indicated by arrow in FIG. 2 to a position where the doctor blade 52Y faces the developing roller 51Y. Then, the amount of developer G on the developing roller 51Y is regulated to a suitable amount by the doctor blade 52Y, after which the developer G is carried to a developing range facing the photoconductor 41Y. In the developing range, the toner T in developer G is attracted to the latent image on the photoconductor 41Y due to the effect of the magnetic field generated between the developing roller 51Y and the photoconductor 41Y. As the sleeve rotates, the developer G remaining on the developing roller 51Y reaches an upper part in the first developer accommodating section 53Y and then drops from the developing roller 51Y.

The toner density in developer G contained in the developing device 50Y is adjusted within a predetermined range.

Specifically, a toner replenishing device 60Y (illustrated in FIG. 4), described later, supplies toner from the toner container 32Y through the toner dropping passage 64Y to the second developer accommodating section 54Y according to the consumption of toner T in the developing device 50Y. The toner T supplied to the second developer accommodating section 54Y circulates between the first developer accommodating section 53Y and the second developer accommodating section 54Y while being mixed and stirred with the developer G by the two developer conveying screws 55Y.

Next, descriptions are given below of the toner containers 32Y, 32M, 32C, and 32K, the toner replenishing devices 60Y, 60M, 60C, and 60K, and the toner container holder 70.

Figure 3:
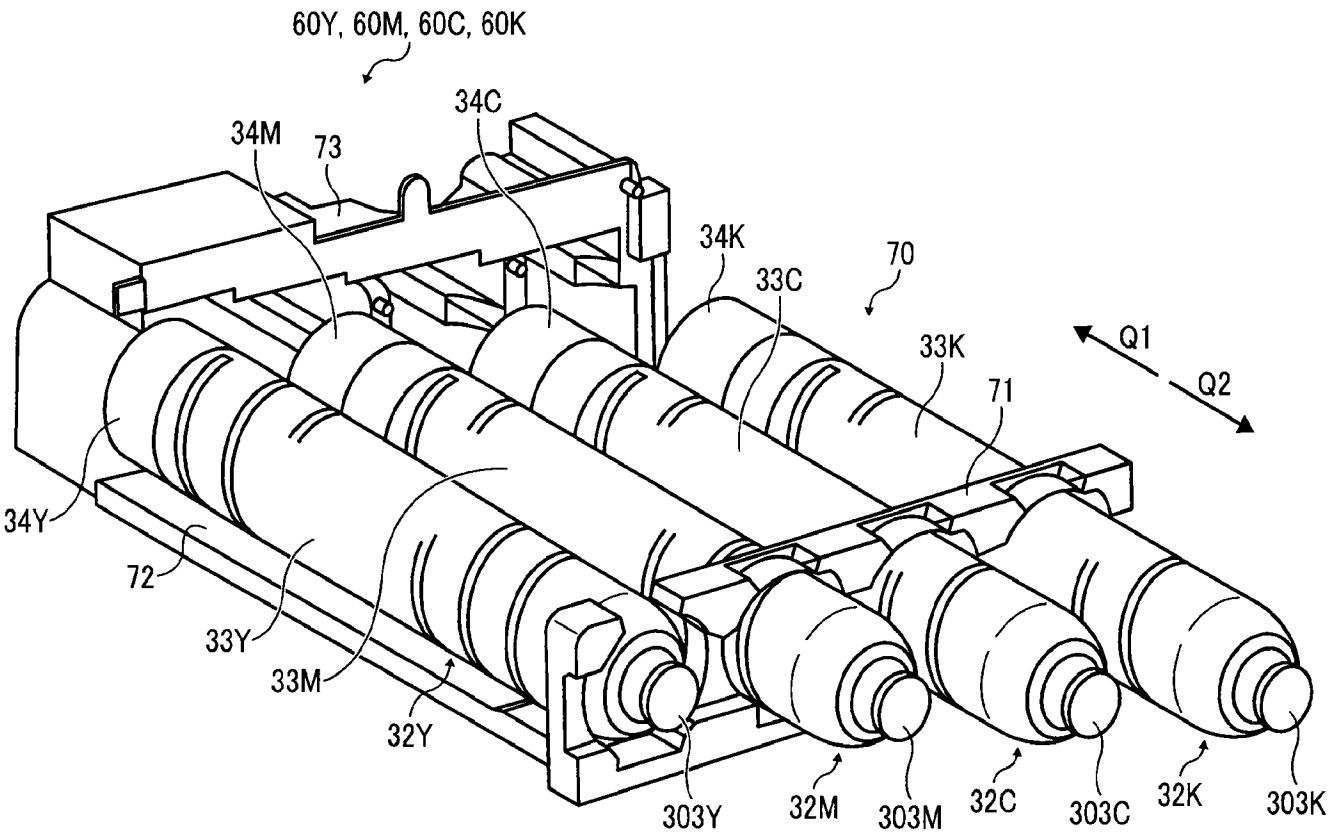
FIG. 3 is a schematic perspective view illustrating a state in which toner containers are mounted in a container holding section according to an embodiment.
Figure 4:
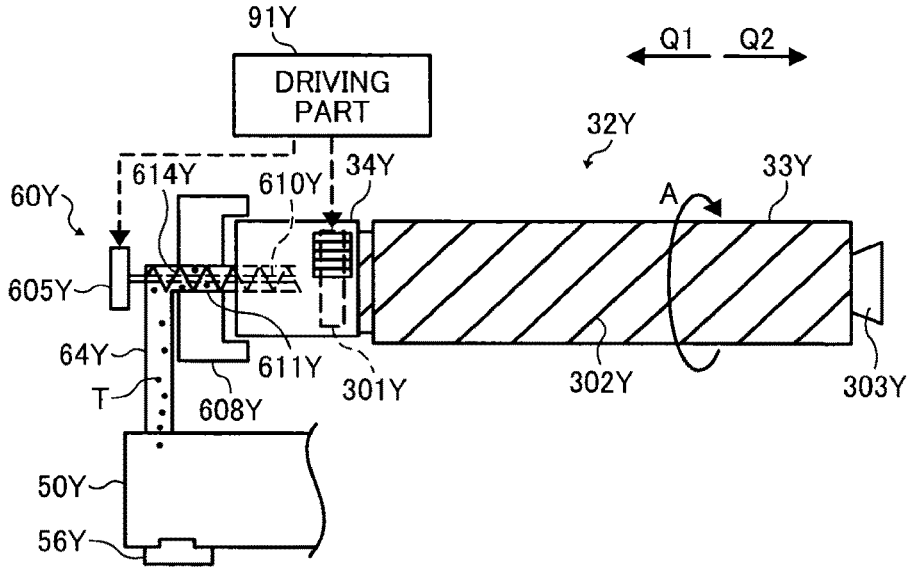
FIG. 4 is a schematic diagram illustrating a toner replenishing device in the image forming apparatus illustrated in FIG. 1 and the toner container attached thereto.

FIG. 3 is a schematic perspective view illustrating a state in which the toner containers 32Y, 32M, 32C, and 32K are mounted in the toner container holder 70. FIG. 4 illustrates the toner replenishing device 60Y and the toner container 32Y attached thereto. The toner replenishing devices 60Y, 60M, 60C, and 60K have a similar configuration except the color of the toner contained therein. Therefore, FIG. 4 illustrates only the toner replenishing device 60Y and the toner container 32Y for yellow, and illustrations of the toner replenishing devices 60M, 60C, and 60K and the toner containers 32M, 32C, and 32K for other three colors are omitted. Although the color-specific suffix Y, M, C, or K representing color-specific structures are used in this specification, some structures are similar regardless of the colors or common among the colors. The suffixes are used in some cases and omitted in some cases. In FIGS. 3 and 4, arrow Q1 indicates an attachment direction in which the toner containers 32 are attached to the toner replenishing devices 60, and arrow Q2 indicates a detachment direction in which the toner containers 32 of the respective colors are detached from the toner replenishing devices 60.

As illustrated in FIG. 3, the toner container 32 mainly includes a substantially cylindrical container body 33, serving as a powder storage, and a container cover 34. The container cover 34 is disposed on the leading side (front side) in the attachment direction Q1. Hereinafter, one side of the toner container 32 where the container cover 34 is disposed in the longitudinal direction is referred to as "a container front end", and the other side of the toner container 32 is referred to as "a container rear end". The container body 33Y is rotatable relative to the container cover 34 around the axis extending in the longitudinal direction of the cylindrical shaped thereof.

The toner container holder 70 mainly includes a container cover receiving section 73, a container receiving section 72, and an insertion hole part 71. The container cover receiving section 73 is a section for holding the container covers 34Y, 34M, 34C, and 34K and the container bodies 33Y, 33M, 33C, and 33K of the toner containers 32Y, 32M, 32C, and 32K. The container receiving section 72 is a section for supporting the container bodies 33Y, 33M, 33C, and 33K of the toner containers 32Y, 32M, 32C, and 32K. An insertion opening for attachment of each of the toner containers 32Y, 32M, 32C, and 32K is defined by the insertion hole part 71. Referring back to FIG. 1, when a front cover of the copier 500 (on the front side of the paper on which FIG. 1 is drawn) is opened, the insertion hole part 71 of the toner container holder 70 is exposed. The toner containers 32 are inserted and removed from the front side of the copier 500, with the longitudinal direction of the toner containers 32 kept horizontal. That is, the longitudinal direction of the toner container 32 coincides with the attachment direction Q1 and the detachment direction Q2.

A longitudinal length of the container receiving section 72 is approximately equal to the longitudinal length of the container body 33Y. The container cover receiving section 73 is disposed on a front end side of the container receiving section 72 in the longitudinal direction thereof (i.e., the front side in the attachment direction Q1). By contrast, the insertion hole part 71 is situated on a rear end side of the container receiving section 72 in the longitudinal direction thereof (i.e., the front side in the detachment direction Q2). The four toner containers 32Y, 32M, 32C, and 32K are slidable on the container receiving section 72. Accordingly, while the toner containers 32Y, 32M, 32C, and 32K are inserted into the toner container holder 70, the container covers 34Y, 34M, 34C, and 34K pass through the insertion hole part 71, slide on the container receiving section 72 for a certain distance, and are then attached to the container cover receiving section 73. Additionally, grippers 303Y, 303M, 303C, 303K are disposed on the rear ends of the toner containers 32Y, 32M, 32C, and 32K (front side in the detachment direction Q2). In replacement of the toner containers 32Y, 32M, 32C, and 32K, users grip the grippers 303Y, 303M, 303C, 303K to pull out the toner containers 32Y, 32M, 32C, and 32K from the toner container holder 70.

As illustrated in FIG. 4, a container gear 301Y is disposed on the front end side of the container body 33Y in the attachment direction Q1. In a state in which the container cover 34Y is attached to the container cover receiving section 73, a rotation driving force is input to the container gear 301Y from a driving part 91Y (container driving part). With the driving force, the container body 33Y rotates in the direction indicated by arrow A illustrated in FIG. 4 (hereinafter "rotation direction A"). The container body 33Y includes a spiral rib 302Y protruding inward from an inner circumferential face of the container body 33Y. As the container body 33Y rotates, the spiral rib 302Y conveys the toner in the container body 33Y from the container rear end to the container front end (from the right to the left in FIG. 5) in the longitudinal direction of the container body 33Y. It is to be noted that the longitudinal direction of the toner container 32 is identical to the axial direction thereof, and the axial direction is kept horizontal in the state in which the toner container 32 is attached to the toner replenishing device 60.

As illustrated in FIG. 4, the toner replenishing device 60Y includes a conveying nozzle 611Y, a conveying screw 614Y, serving as a conveyor, disposed inside the conveying nozzle 611Y, the toner dropping passage 64Y connected to the downstream end of the conveying nozzle 611Y in the toner conveyance direction, and the like. The toner replenishing device 60Y further includes a setting cover 608Y to removably hold the container cover 34Y of the toner container 32Y. The setting cover 608Y is a part of the container cover receiving section 73 of the toner container holder 70. It is to be noted that the toner replenishing devices 60M, 60C, and 60 K have a configuration similar to that of the toner replenishing device 60Y.

As the toner container 32Y is inserted in the attachment direction Q1 in FIG. 4 and set to the setting cover 608Y, in conjunction with the setting, the conveying nozzle 611Y of the toner replenishing device 60Y (the toner supply device) is inserted into the toner container 32Y from the front end of the toner container 32Y. With this action, an interior of the toner container 32Y communicates with the conveying nozzle 611Y. The structure relating to this action is described in detail later.

In this state, when the container body 33Y rotates to transport the toner therein from the container rear end to the container front end, the toner is supplied inside the conveying nozzle 611Y via a nozzle hole 610Y serving as a nozzle opening (powder receiving inlet), disposed on an end of the conveying nozzle 611Y. Subsequently, the driving part 91Y (container driving part) inputs the driving force to a conveying screw gear 605Y, which is disposed at an end of the conveying screw 614Y, and the conveying screw 614Y rotates to convey the toner T inside the conveying nozzle 611Y. Then, the toner conveyed by the toner conveyance screw 62Y drops under its own weight through the toner dropping passage 64Y and is supplied to the second developer accommodating section MY of the developing device 50Y.

It is to be noted that, in the toner replenishing device 60 according to the present embodiment, the amount of toner supplied to the developing device 50 is controlled with the rotation speed of the conveying screw 614. Although the toner transported through the conveying nozzle 611 is directly supplied to the developing device 50 via the toner dropping passage 64 in the present embodiment, alternatively, a temporary toner reservoir (such as a toner hopper) is disposed between the toner dropping passage 64 and the developing device 50 in another embodiment.

Figure 5:
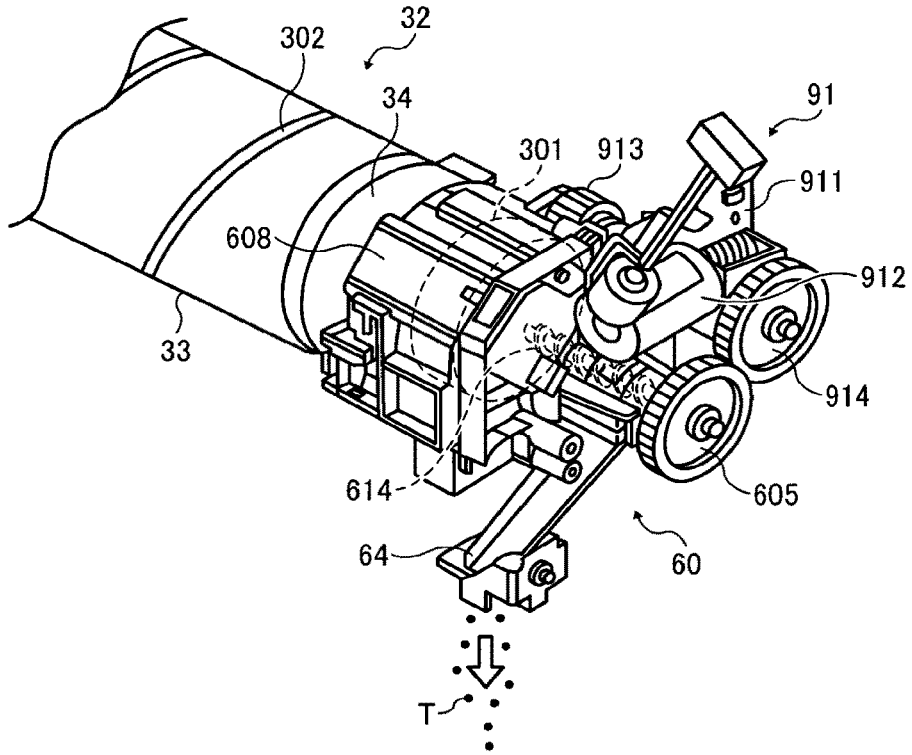
FIG. 5 is a perspective view of a driving part according to an embodiment.

The driving part 91 is described with reference to FIG. 5. It is to be noted that, in FIG. 5, the color-specific suffixes are omitted for simplicity. The driving part 91 includes a driving motor 912 secured to a mounting frame 911, a container driving gear 913, and a screw driving gear 914. The container driving gear 913 is coupled to the container gear 301 disposed at the toner container 32. The screw driving gear 914 is coupled to the conveying screw gear 605 disposed at the conveying screw 614. The driving motor 912 drives the container driving gear 913 and the screw driving gear 914, and an output gear thereof rotates, thereby transmitting the driving force. Thus, the driving force is transmitted to the container gear 301 as well as the conveying screw gear 605, and the container body 33 and the conveying screw 614 are rotated.

Next, the toner containers 32Y, 32M, 32C, and 32K and the toner replenishing devices 60Y, 60M, 60C, and 60K are described in detail below with reference to FIGS. 6 and 7. As described above, the four toner containers 32 and the four toner replenishing devices 60 have similar configurations except the color of toner contained therein, and the suffixes Y, M, C, and K may be omitted when color discrimination is not necessary.

Figure 6:
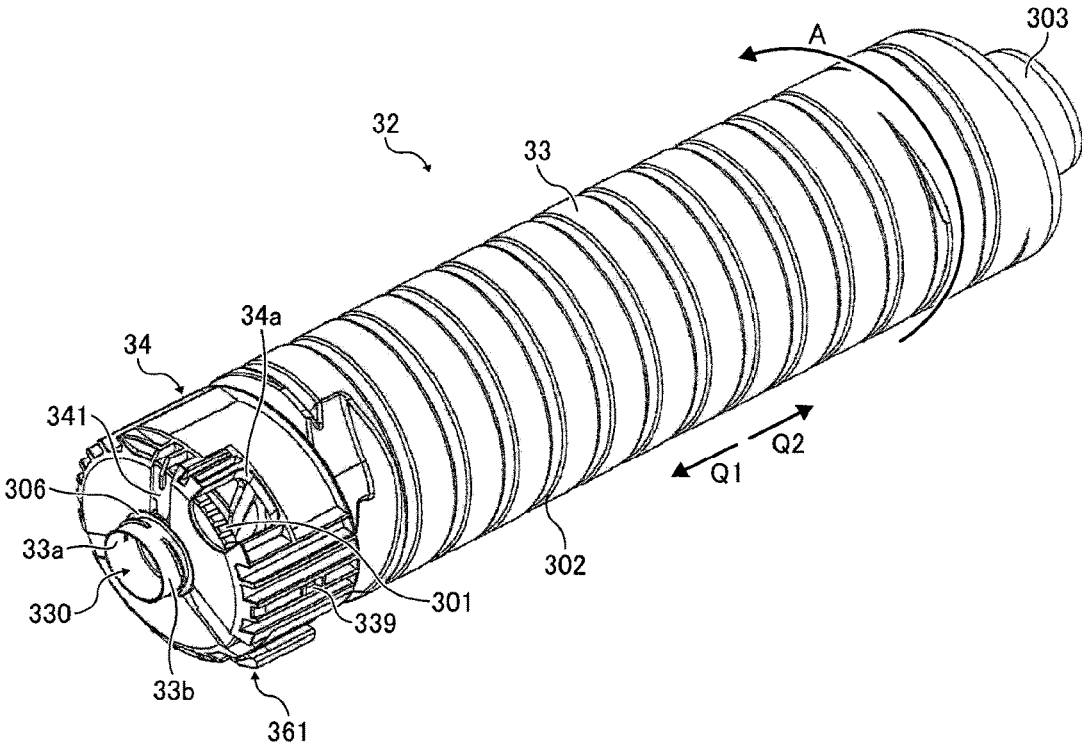
FIG. 6 is a perspective view of the toner container.
Figure 7:
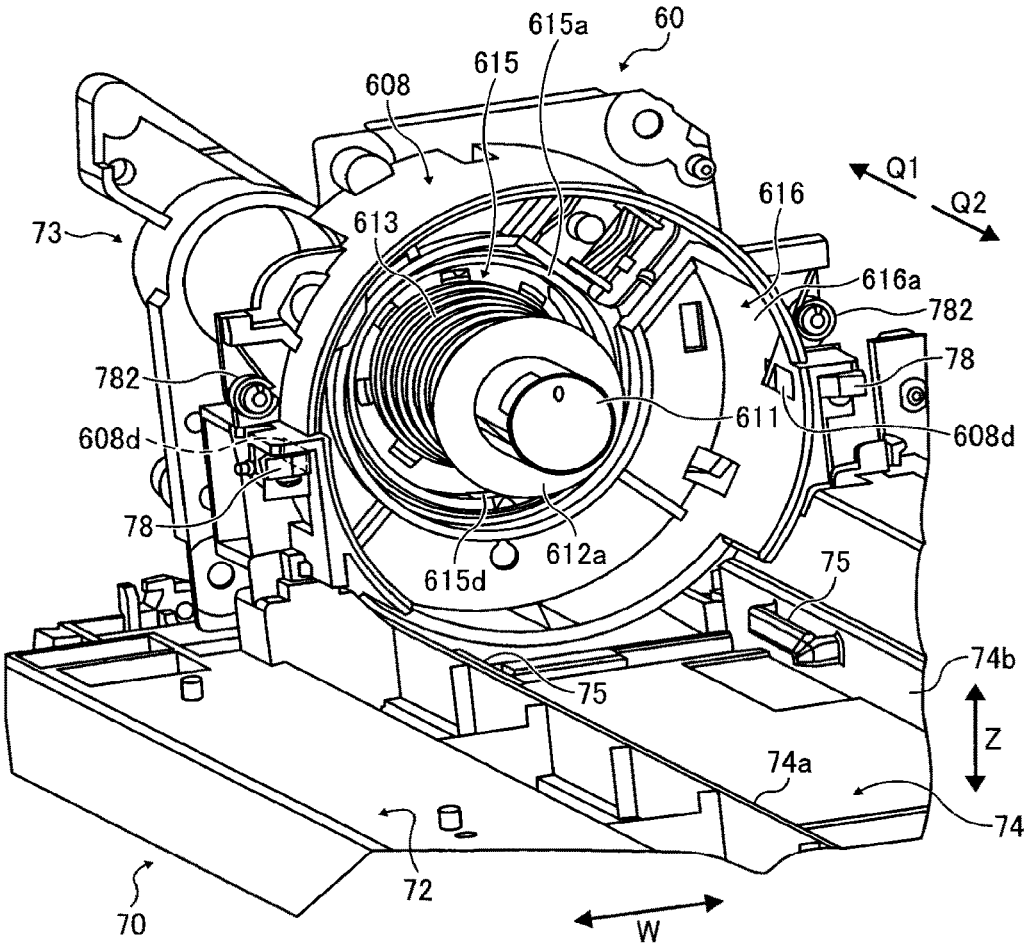
FIG. 7 is a perspective view of the toner replenishing device.

FIG. 6 is a perspective view illustrating the toner container 32, and FIG. 7 is a perspective view of the toner replenishing device 60.

As illustrated in FIG. 6, the container cover 34 covers the front end of the container body 33. The container cover 34 includes a gear exposing opening 34*a* so that a part of the container gear 301 of the container body 33 is exposed when the container body 33 is covered with the container cover 34. With this configuration, when the toner container 32 is attached to the toner replenishing device 60, the container gear 301 exposed from the gear exposing opening 34*a* meshes with the container driving gear 913 of the driving part 91 (illustrated in FIG. 5).

The container body 33 includes a cylindrical container opening 33*a* positioned closer to the front end of the container body 33 than (downstream in the attachment direction Q1 from) the container gear 301 and disposed concentric with the container gear 301. The container opening 33*a* projects beyond the front end of the container cover 34 in the state in which the container body 33 is covered with the container cover 34. Further, a ring-shaped cover hook stopper 306 serving as a stopper is disposed on an outer surface 33*b* of the container opening 33*a* projecting beyond the front end of the container cover 34. By contrast, on the front end face of the container cover 34, a cover hook 341 serving as a cover-side retainer is disposed such that an end of the cover hook 341 is oriented to the outer surface 33*b* of the container opening 33*a*. As the container cover 34 is attached to the container body 33, the cover hook 341 is hooked on the cover hook stopper 306, and movement of the container cover 34 is restricted. In other words, the cover hook 341 is located between the cover hook stopper 306 and the container gear 301. Additionally, the ring-shaped cover hook stopper 306 is disposed extending in the direction of rotation of the container body 33 indicated by arrow A, and the cover hook stopper 306 slides on the cover hook 341 in the direction of rotation of the container body 33 as the container body 33 rotates.

As illustrated in FIG. 6, on the outer circumference of the container cover 34, a pair of sliding guides 361 serving as a guide is disposed in a lower portion. Although only one of the sliding guides 361 is illustrated in FIG. 6, the other sliding guide 361 is disposed so that the sliding guides 361 face each other in the direction perpendicular to the attachment direction Q1. The sliding guides 361 extend in the longitudinal direction of the container body 33. The sliding guides 361, together with a pair of guide rails disposed on the toner container holder 70, guide the toner container 32 being inserted in the attachment direction Q1 while inhibiting the toner container 32 from moving in directions other than the attachment direction Q1.

Additionally, the outer surface of the container cover 34 includes a pair of retaining holes 339 in which replenishing device engaging members (described later) of the toner replenishing device are caught. Although only one retaining hole 339 is illustrated in FIG. 6, the other retaining hole 339 is disposed on the side opposite the retaining hole 339 illustrated in FIG. 6.

As illustrated in FIG. 7, the toner replenishing device 60 includes the setting cover 608 to hold each toner container 32. The setting cover 608 is substantially cylindrical and an inner surface of the setting cover 608 is shaped stepwise to reduce the inner diameter thereof in the attachment direction Q1 in stepwise manner. Out of the setting cover 608, a portion where the inner diameter is reduced to is a container setting section 615 to hold the container opening 33*a* of the container body 33. That is, the setting cover 608 includes the container setting section 615 having an inner surface 615*a* (small-diameter inner surface) and disposed on the front end side of the setting cover 608 in the attachment direction Q1. Out of the setting cover 608, a portion where the inner diameter is greater than the inner surface 615*a* is a cover setting section 616 to hold the container cover 34. That is, the cover setting section 616 has an inner surface 616*a* (large-diameter inner surface). The conveying nozzle 611 protruding in the front side in the detachment direction Q2 is disposed in a center portion of the container setting section 615 and a center portion of the cover setting section 616.

When the toner container 32 is attached to the toner replenishing device 60, the outer surface 33*b* of the container opening 33*a* of the toner container 32 rotatably fits in the container setting section 615. Specifically, the inner surface 615*a* of the container setting section 615 includes four contact surfaces 615*d* projecting inward in the radial direction. The contact surfaces 615*d* are evenly spaced in the circumferential direction (in the arc-shaped direction). As the toner container 32 rotates, the outer surface 33*b* of the container opening 33*a* slide on the contact surfaces 615*d*.

That is, the container setting section 615 serves as a bearing to support the container opening 33*a*, which functions as a rotation shaft when the container body 33 rotates. Additionally, in the state in which the container opening 33*a* is fitted in the container setting section 615, the radial position of the container opening 33*a* is determined.

By contrast, the container cover 34 of the toner container 32 is fitted in the cover setting section 616 not to rotate in the state in which the toner container 32 is mounted in the toner replenishing device 60. Specifically, the cover setting section 616 includes a pair of replenishing device engaging members 78 (lock lever) to hold the container cover 34 in position. The replenishing device engaging members 78 are disposed on the outer surface of the cover setting section 616 on the opposite sides in a width direction indicated by arrow W in FIG. 7 (hereinafter "width direction W") perpendicular to the longitudinal direction of the toner container 32. As illustrated in FIG. 7, the cover setting section 616 includes holes 608*d* (i.e., holes of the setting cover 608) disposed facing each other in the width direction W. Via the holes 608*d*, the replenishing device engaging members 78 are retractable from the outer side to the inner side of the cover setting section 616. The replenishing device engaging members 78 are biased from the outer side to the inner side of the cover setting section 616 by torsion coil springs 782, serving as biasing members, disposed on the outer surface of the cover setting section 616. With this configuration, as the toner container 32 is attached to the toner replenishing device 60, the replenishing device engaging members 78 biased by the torsion coil springs 782 enter the retaining holes 339 of the container cover 34. Then, the replenishing device engaging members 78 are retained in the retaining holes 339, and the container cover 34 are held in the cover setting section 616 not to rotate.

Referring to FIG. 7, the container receiving section 72 on the bottom of the toner container holder 70 includes four gutters 74 divided in the width direction W. Each gutter 74 serves as a container mounting section for one of the container bodies 33 (32Y, 32M, 32C, and 32K). The gutters 74 extend from the container cover receiving section 73 to the insertion hole part 71 in the longitudinal direction of the container bodies 33. The toner containers 32 are slidable on the gutters 74 in the longitudinal direction.

On side surfaces 74*a* and 74*b* disposed at both ends of the gutter 74 in the width direction W and facing each other, guide rails 75 are disposed facing each other. The guide rails 75 protrude inward in the width direction W from the side surfaces 74*a* and 74*b*, respectively, and extend in the longitudinal direction. The guide rails 75 are located upstream from the container cover receiving section 73 in the attachment direction Q1. The guide rails 75 fit with the sliding guides 361 disposed on the toner container 32 when the toner container 32 is attached to the toner replenishing device 60. The term "fit" used here means that the guide rails 75 are movably inserted in grooves of the sliding guides 361. That is, as the sliding guides 361 move along the guide rails 75, the container opening 33*a* of the toner container 32 is guided to the container setting section 615 of the toner replenishing device 60. Fitting with the sliding guides 361, the guide rails 75 restrict movement of the toner container 32 in a vertical direction Z (in FIG. 7) as well as the width direction W. Thus, the guide rails 75 being fitting with the sliding guides 361 determine the position of the toner container 32.

Figure 8:
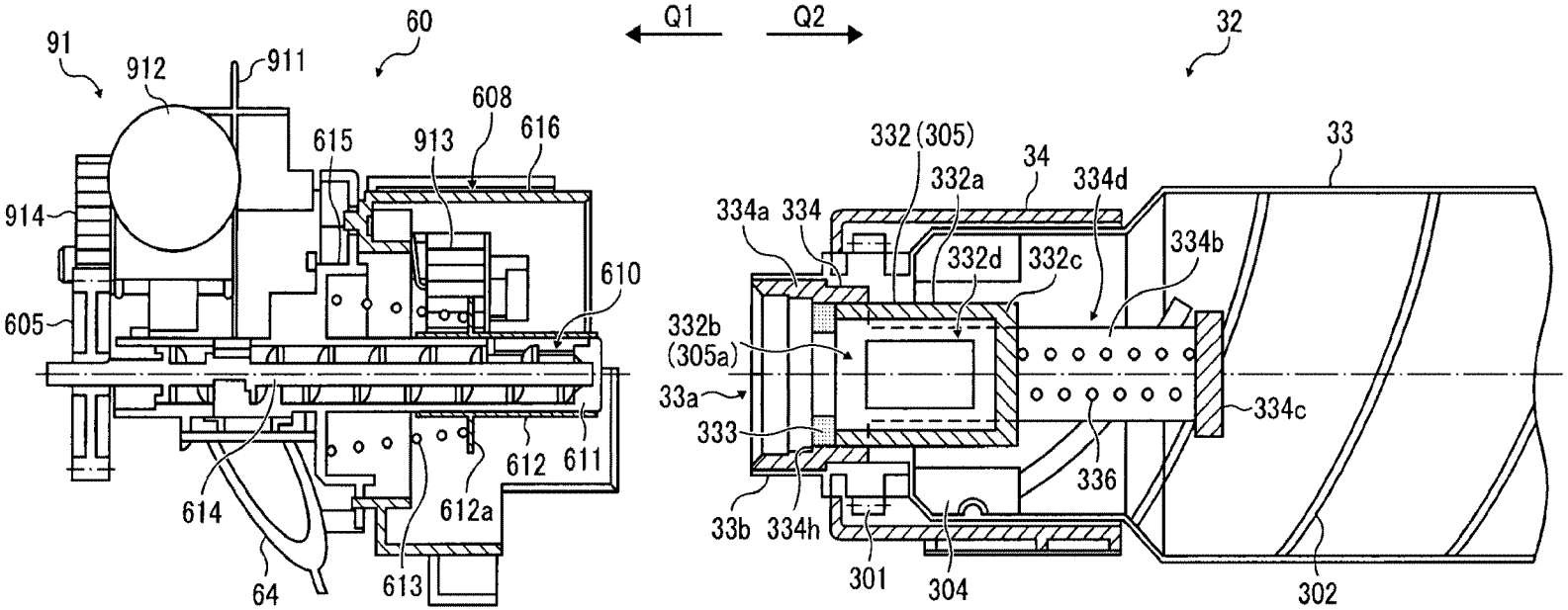
FIG. 8 is a schematic cross-sectional view illustrating a state in which the toner container is not mounted in the toner replenishing device.
Figure 9:
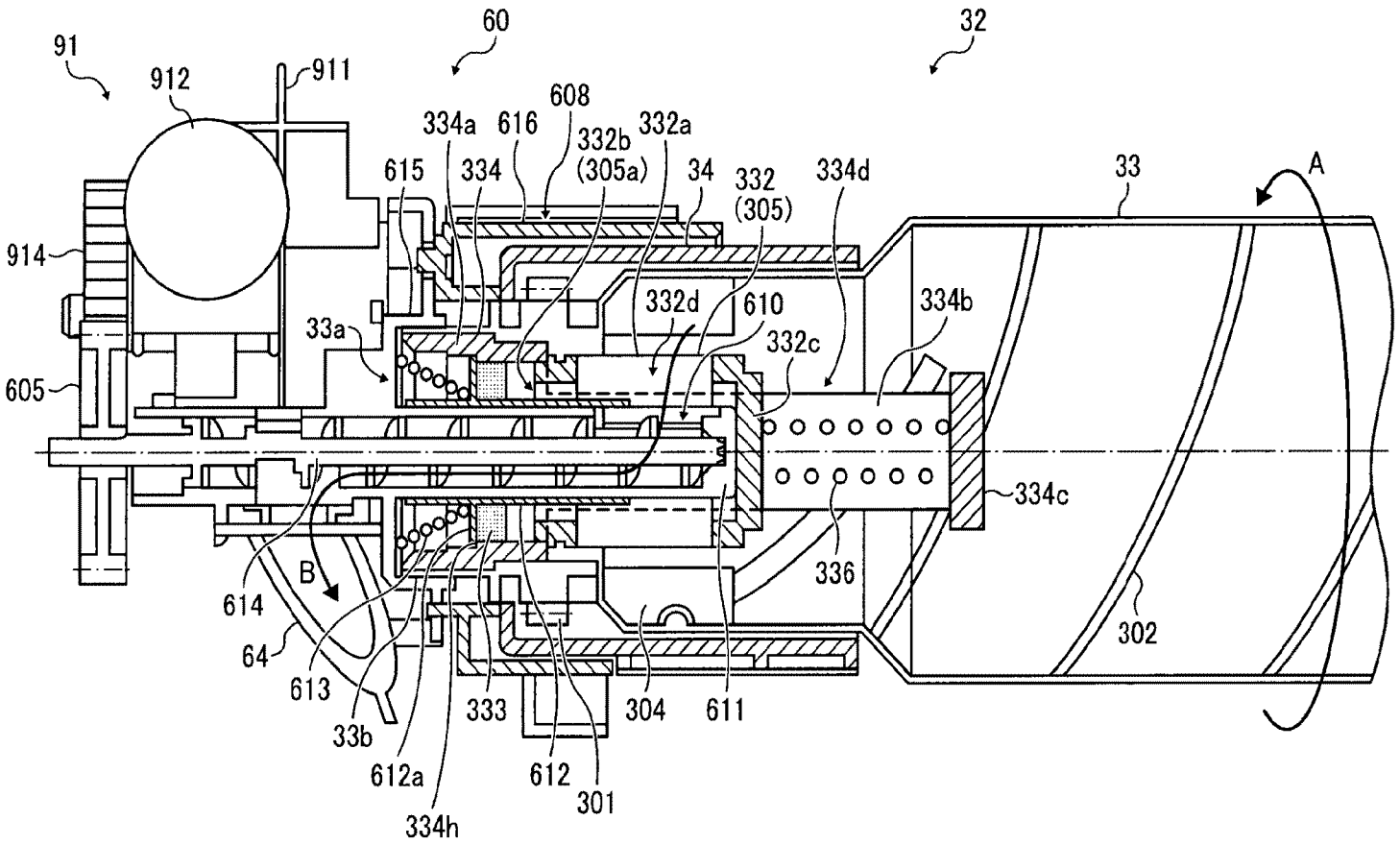
FIG. 9 is a schematic cross-sectional view illustrating a state in which the toner container is mounted in the toner replenishing device.

Referring to FIGS. 8 and 9, the toner container 32 and the toner replenishing device 60 are described in further detail below.

FIGS. 8 and 9 are schematic cross-sectional views of the toner container 32 and the toner replenishing device 60. FIG. 8 illustrates a state in which the toner container 32 is not mounted in the toner replenishing device 60, and FIG. 9 illustrates a state in which the toner container 32 is mounted in the toner replenishing device 60.

As illustrated in FIG. 8, a cylindrical nozzle shutter 612 is attached to the outer surface of the conveying nozzle 611 of the toner replenishing device 60. The nozzle shutter 612 opens and closes the nozzle hole 610 of the conveying nozzle 611. The nozzle shutter 612 is slidable to move between a closed position to close the nozzle hole 610 (illustrated in FIG. 8) and an open position to open the nozzle hole 610 (illustrated in FIG. 9). The nozzle shutter 612 includes a ring-shaped nozzle shutter flange 612*a* projecting radially from the outer surface of the nozzle shutter 612 (see FIG. 7). The nozzle shutter flange 612*a* is biased to the end of the conveying nozzle 611 (front side in the detachment direction Q2) by a nozzle shutter spring 613 disposed in the setting cover 608. With the biasing force exerted by the nozzle shutter spring 613, the nozzle shutter 612 is retained at the closed position to close the nozzle hole 610 in the state illustrated in FIG. 8, in which the toner container 32 is not attached to the toner replenishing device 60.

Additionally, the toner container 32 includes a nozzle receiver 330 (illustrated in FIG. 6) and scooping portions 304 (illustrated in FIG. 8) to scoop the toner upward by rotation of the container body 33. The nozzle receiver 330 is attached to the container opening 33*a* of the container body 33. The nozzle receiver 330 is an assembly that includes a container shutter 332, a container seal 333, a container shutter holder 334 to hold the container shutter 332, and a container shutter spring 336 to bias the container shutter 332. The biasing member is not limited to a spring, but can include an elastic body such as a rubber component and a solenoid. Although the details are described later, in the state in which the nozzle receiver 330 is attached to the container opening 33*a* of the container body 33, the container shutter 332 blocks the interior of the toner container 32 from the outside. The container shutter 332 serves as the nozzle receiving portion 305 including the nozzle insertion opening 305*a* (nozzle insertion opening) to which the conveying nozzle 611 is inserted.

In the configuration illustrated in FIG. 8, the scooping portions 304 are upheavals of the inner wall of the end portion of the container body 33. However, the scooping portions 304 are not limited thereto. Alternatively, for example, paddle-like components can be provided instead. As the container body 33 rotates, the scooping portions 304 rotate together with the container body 33 to scoop up the toner, which is conveyed to the container front end by the spiral rib 302.

The container seal 333 is ring-shaped and elastic. The container seal 333 is disposed outward (on the front end side of the container body 33) from the container shutter 332. As illustrated in FIG. 9, the container seal 333 seals clearance between the nozzle shutter 612 and the container shutter holder 334 in a state in which the conveying nozzle 611 is in the nozzle insertion opening 305*a*. Thus, the container seal 333 inhibits leak of toner from the toner container 32 in the state in which the conveying nozzle 611 is inserted therein.

Figure 10:
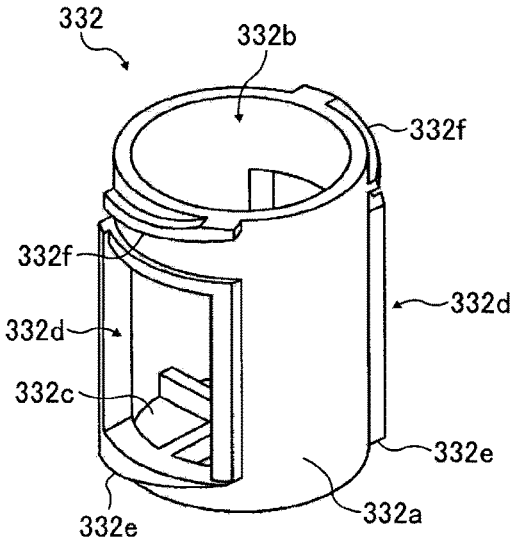
FIG. 10 is a perspective view of a container shutter according to an embodiment.
Figure 11:
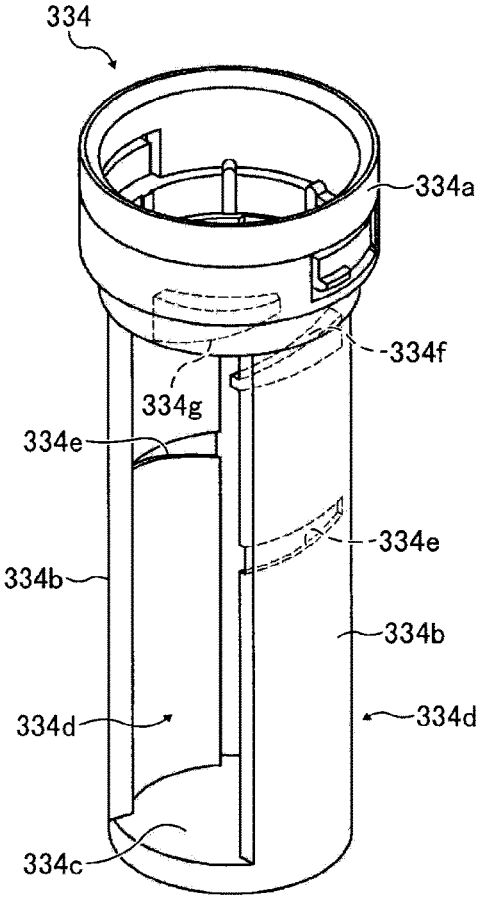
FIG. 11 is a perspective view of a container shutter supporter according to an embodiment.
Figure 12:
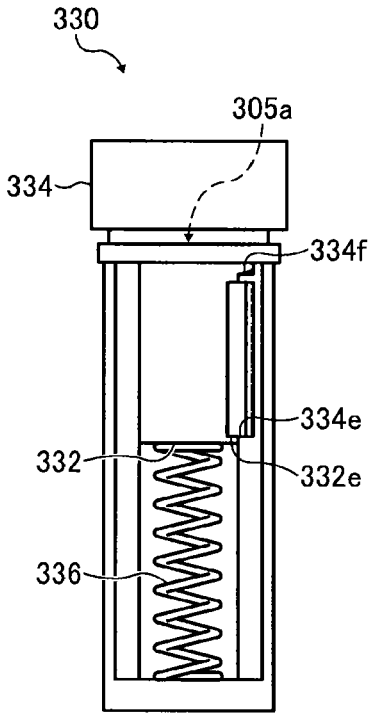
FIG. 12 illustrates a nozzle receiver as an assembly including the container shutter supporter and the container shutter attached thereto.

Referring to FIGS. 10, 11, and 12, the nozzle receiver 330, the container shutter 332, and the container shutter holder 334 are described below.

FIG. 10 is a perspective view of the container shutter 332, and FIG. 11 is a perspective view of the container shutter holder 334. FIG. 12 illustrates the nozzle receiver 330 as an assembly including the container shutter 332 and the like attached to the container shutter holder 334.

As illustrated in FIG. 10, the container shutter 332 is a cylindrical component that is open at one end (an upper end in FIG. 10) and closed at the other end (i.e., a closed bottom) in the axial direction of the container shutter 332. Specifically, the container shutter 332 includes a cylindrical wall portion 332*a* (i.e., an opening and closing member), a cylindrical opening 332*b* at the open end of the cylindrical wall portion 332*a*, and a nozzle end receiving portion 332*c* (serving as the bottom of the cylindrical wall portion 332*a*) disposed at the closed end of the cylindrical wall portion 332*a*. The cylindrical wall portion 332*a* includes a pair of shutter side openings 332*d* disposed facing each other in the circumferential direction. With the shutter side openings 332*d*, a through hole penetrates the cylindrical wall portion 332*a* in the radial direction.

It is to be noted that, in the state in which the container shutter 332 is contained in the container shutter holder 334 and attached, as the nozzle receiver 330, to the container opening 33*a* of the container body 33, the cylindrical opening 332*b* forms the nozzle insertion opening 305*a* to receive the conveying nozzle 611, and the container shutter 332 including the nozzle end receiving portion 332*c* serves as the nozzle receiving portion 305.

Additionally, the cylindrical wall portion 332*a* includes guides 332*e* and 332*f* projecting radially from the outer surface thereof and facing each other in the axial direction. The guides 332*e* and 332*f* extend in the circumferential direction in a spiral manner. In the present embodiment, the guides 332*e* and 332*f* are at the both axial ends of a portion of the container shutter 332 where the shutter side opening 332*d* is formed. That is, two guides 332*f* are disposed at the side of the cylindrical opening 332*b* and oppose each other in the diameter direction, and two guides 332*e* are disposed at the side of the nozzle end receiving portion 332*c* and oppose each other in the diameter direction. Thus, the number of the guides 332*e* and 332*f* in total is four in FIG. 10. However, the number thereof is not limited to four.

By contrast, as illustrated in FIG. 11, the container shutter holder 334 includes a cylindrical attached portion 334*a* secured to the container body 33, a pair of shutter supporting portions 334*b* extending from one end of the attached portion 334*a* in the axial direction of the attached portion 334*a*, and a spring receiving portion 334*c* disposed at the ends of the shutter supporting portion 334*b* opposite the attached portion 334*a*. The shutter supporting portions 334*b* support the container shutter 332 rotatably. The spring receiving portion 334*c* receives one end of the container shutter spring 336. Each shutter supporting portion 334*b* is shaped into an arc and has an inner surface coaxial with the attached portion 334*a*, and holder side openings 334*d* are secured between the shutter supporting portions 334*b*. In other words, each shutter supporting portion 334*b* is shaped as if a wall of a cylindrical component is cut away at two portions facing each other.

Each shutter supporting portion 334*b* includes guides 334*e* and 334*f* disposed on the inner surface thereof, facing each other in the axial direction and extending in the circumferential direction in a spiral manner. The guides 334*e* and 334*f* cooperate with the guides 332*e* and 332*f* of the container shutter 332 to rotate the container shutter 332. The guides 334*e* and 334*f* include inclined faces to guide the container shutter 332 to rotate around an axis of the conveying nozzle 611 extending in the nozzle insertion direction. Corresponding to the guides 332*e* and 332*f* of the container shutter 332, the number of the guides 334*e* and 334*f* in total is four. Specifically, in FIG. 11, a pair of guides 334*e* and a pair of guides 334*f* are respectively disposed at an intermediate position and the end (on the side of the attached portion 334*a*) of the shutter supporting portion 334*b* in the longitudinal direction (axial direction). It is to be noted that, one of the guides 334*f* disposed at the open end of the shutter supporting portion 334*b* is omitted in FIG. 11 for simplicity.

In the present embodiment, the guides 334*f* at the end on the side of the attached portion 334*a* are projections, and the guides 334*e* at the intermediate position are guide grooves. Alternatively, both of the guide 334*e* and the guide 334*f* can be projections, and yet alternately, both can be grooves. In a configuration in which both of the guide 334*e* and the guide 334*f* are projections, the guides 332*e* and 332*f* of the container shutter 332 can be grooves.

On the inner surface of the attached portion 334*a*, a pair of guides 334*g*, different from the guide 334*e* and the guide 334*f*, is disposed facing each other. It is to be noted that, one of the guides 334*g* of the attached portion 334*a* is omitted in FIG. 11 for simplicity. Although the guides 334*g* of the attached portion 334*a* are spiral-shaped similar to the guides 334*e* and 334*f* of the shutter supporting portion 334*b*, the guides 334*g* are for rotating the container shutter 332 in the direction opposite the direction of rotation of the container shutter 332 guided by the guides 334*e* and 334*f* It is to be noted that the rotation of the container shutter 332 guided by those guides are described in detail later. In the present embodiment, the guides 334*g* are projections, but the guides 334*g* can be grooves.

As illustrated in FIG. 8, in the state in which the container shutter holder 334 is attached to the container body 33, the container shutter holder 334 is disposed with the attached portion 334*a* facing the front side of the container body 33 (front side in the attachment direction Q1). Then, the attached portion 334*a* is fitted in the container opening 33*a* of the container body 33, thereby securing the container shutter holder 334 to the container body 33. In the present embodiment, as illustrated in FIG. 11, a projection projecting outward from the circumference is fitted in a recess of the container body 33. That is, so-called snap-fit is used. To fill the container body 33 with toner, initially, the container opening 33*a* is faced up, and the toner is put in the container body 33 from the container opening 33*a*, after which the container shutter holder 334 is attached to the container body 33.

Additionally, as illustrated in FIG. 8, the container shutter 332 is contained in the container shutter holder 334 with the cylindrical opening 332*b* facing the front side (front side in the attachment direction Q1) of the container body 33. The container shutter 332 is disposed in the container shutter holder 334 coaxially with the container shutter holder 334, and the attached portion 334*a* and the pair of shutter supporting portions 334*b* support the container shutter 332 rotatably. The container shutter spring 336 is disposed, in a compressed state, between the nozzle end receiving portion 332*c* of the container shutter 332 and the spring receiving portion 334*c* of the container shutter holder 334. With the compressed container shutter spring 336, the container shutter 332 is biased to the attached portion 334*a* of the container shutter holder 334.

As illustrated in FIG. 9, as the toner container 32 is attached to the toner replenishing device 60, the conveying nozzle 611 passes through the cylindrical opening 332*b* (i.e., the nozzle insertion opening 305*a*), and enters the container shutter 332. Then, the conveying nozzle 611 is held by the nozzle receiving portion 305 of the container shutter 332. At that time, the nozzle shutter flange 612*a* of the nozzle shutter 612 contacts multiple contact ribs 334*h* disposed on the inner surface of the attached portion 334*a*, and then the nozzle shutter 612 moves to the rear end side relative to the conveying nozzle 611. Accordingly, the nozzle hole 610 of the conveying nozzle 611 opens.

In a state in which the container seal 333 projects to the container front end beyond the contact ribs 334*h*, the container seal 333 is secured to the inner surface of the attached portion 334*a* with adhesive tape, glue, or the like. Therefore, when the toner container 32 is attached to the toner replenishing device 60, the nozzle shutter flange 612*a* of the nozzle shutter 612 of the toner replenishing device 60, biased by the nozzle shutter spring 613, compresses the projecting portion of the container seal 333. This configuration enhances the sealing capability of the container seal 333 in attachment of the toner container 32, thereby reliably prevent the leak of toner.

Additionally, as illustrated in FIG. 9, in attachment of the toner container 32, insertion of the conveying nozzle 611 causes the container shutter 332 to rotate, and the shutter side openings 332*d* is positioned facing the nozzle hole 610. In this state, the inside of the container body 33 communicates with the inside of the conveying nozzle 611. In this state, as the container body 33 rotates in the rotation direction A, driven by the driving part 91, the toner inside the container body 33 is conveyed to the container front end by the spiral rib 302 and scooped up by the scooping portions 304 that is rotating. Then, the scooped toner drops and enters the conveying nozzle 611 through the nozzle hole 610. In the conveying nozzle 611, the conveying screw 614, driven with the driving force from the driving part 91, conveys the toner through a route indicated by arrow B to the toner dropping passage 64. The toner falls through the toner dropping passage under the gravity and is supplied to the developing device 50.

As described above, the container shutter 332 rotates in accordance with the insertion of the conveying nozzle 611 in the present embodiment. This action is described further with reference to FIGS. 13 through 14C.

Figure 13:
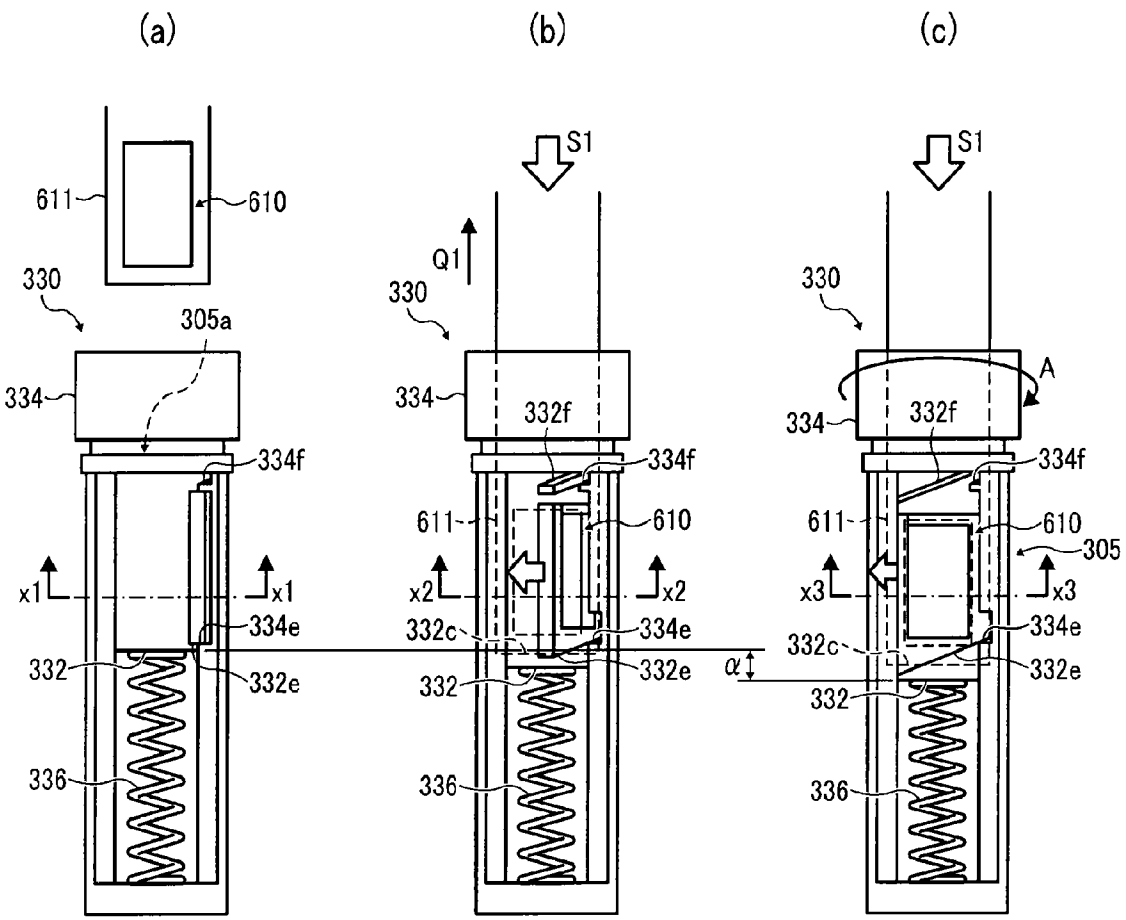
FIG. 13 illustrates rotation of the container shutter in accordance with insertion of a conveying nozzle.
Figure 14A:
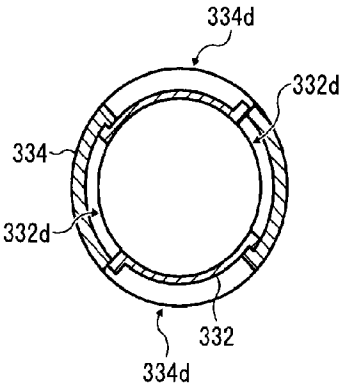
FIGS. 14A, 14B, and 14C are cross-sectional views corresponding to cross-sectional views (a), (b), and (c) in FIG. 13, respectively.
Figure 14B:
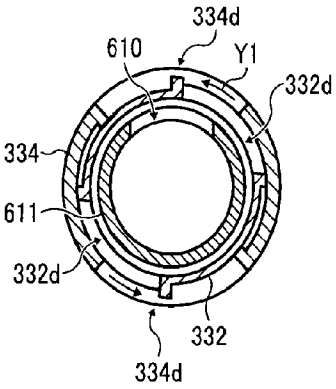
Figure 14C:
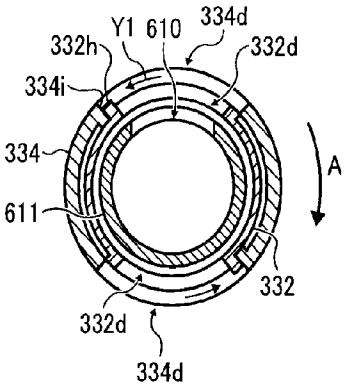

FIG. 13 illustrates the rotation of the container shutter 332 in accordance with the insertion of the conveying nozzle 611, and FIGS. 14A, 14B, and 14C are cross-sectional views corresponding to cross-sectional views (a), (b), and (c) in FIG. 13, respectively. That is, FIGS. 14A, 14B, and 14C are cross-sectional views along lines x1-x1, x2-x2, and x3-x3 in the cross-sectional views (a), (b), and (c) in FIG. 13, respectively.

FIG. 13(*a*) illustrates a state before the conveying nozzle 611 is inserted into the container shutter 332, that is, before the toner container 32 is attached to the toner container 32. In this state, as illustrated in FIG. 14A, the shutter side openings 332*d* do not face the holder side openings 334*d*. Accordingly, the shutter side openings 332*d* are closed with the wall face of the container shutter holder 334, and the holder side openings 334*d* are closed with the wall face of the container shutter 332. That is, in this state, the inside of the toner container 32 does not communicate with the outside (inside of the conveying nozzle 611), and the holder side opening 334*d* of the container shutter holder 334 is closed with the container shutter 332.

Figure 15:
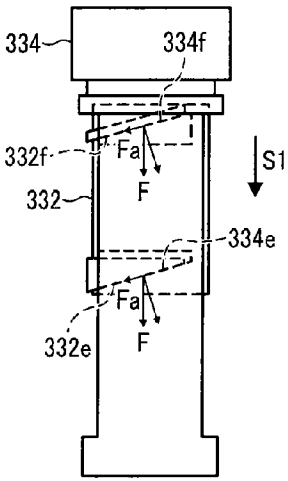
FIG. 15 is a schematic diagram illustrating a force acting on the container shutter.

As the toner container 32 is moved in the attachment direction Q1 from the position illustrated in FIG. 13(*a*) to the position illustrated in FIG. 13(*b*), the conveying nozzle 611 is inserted into the container shutter 332 as illustrated in FIG. 13(*b*), and the end of the conveying nozzle 611 contacts the nozzle end receiving portion 332*c* of the container shutter 332. Then, as the conveying nozzle 611 pushes the nozzle end receiving portion 332*c* in the direction indicated by arrow S1 (hereinafter "nozzle insertion direction S1"), the container shutter 332 starts rotating in the direction indicated by arrow Y1 (illustrated in FIG. 14B, hereinafter "opening direction Y1") along the guides 334*e* and 334*f* of the container shutter holder 334. Specifically, when the container shutter 332 is pushed in the nozzle insertion direction S1, a pressing force F (in the nozzle insertion direction S1) acts between the guides 332*e* and 332*f* of the container shutter 332 and the corresponding guides 334*e* and 334*f* of the container shutter holder 334 as illustrated in FIG. 15. Then, a component Fa of the pressing force F acts in the direction along the guides 334*e* and 334*f*, and the component Fa causes the container shutter 332 to rotate around the axis thereof.

As the conveying nozzle 611 pushes the container shutter 332 further in the nozzle insertion direction S1, the container shutter 332 continues to rotate along the guides 334*e* and 334*f* of the container shutter holder 334. When the container shutter 332 is fully pushed in the nozzle insertion direction S1 by the conveying nozzle 611, as illustrated in FIGS. 13(*c*) and 14C, the shutter side openings 332*d* of the container shutter 332 are positioned facing the respective holder side openings 334*d* of the container shutter holder 334, and the container shutter 332 stops rotating. In FIG. 13, "a" represents a stroke by which the container shutter 332 moves in the nozzle insertion direction S1 and the opposite direction.

In the state in which the shutter side openings 332*d* are positioned facing the respective holder side openings 334*d* of the container shutter holder 334, the upper side of the nozzle hole 610 is fully open. In this state, the holder side opening 334*d* of the container shutter holder 334 is open so that the toner in the container body 33 is conveyed through the route indicated by arrow B in FIG. 9.

Additionally, as the container body 33 is rotated in this state by the driving part 91, the container shutter holder 334 rotates in the rotation direction A indicated in the cross-sectional view (c) in FIG. 13 and FIG. 14C. At that time, since the force of inertial acts on the container shutter 332 to keep the container shutter 332 stationary, the container shutter 332 is about to rotate in the direction opposite the rotation direction A relative to the container shutter holder 334. However, a projecting rim 332*h* of the shutter side openings 332*d* contacts a rim 334*i* of the shutter supporting portion 334*b* of the container shutter holder 334 as illustrated in FIG. 14C, and the rims 332*h* and 334*i* together serve as a rotation restrictor to inhibit the container shutter 332 from rotating relative to the container shutter holder 334. Accordingly, the container shutter 332 rotates together with the container shutter holder 334.

As described above, when the container body 33 rotates, the shutter side openings 332*d* and the holder side openings 334*d* are kept facing each other since the container shutter 332 rotates together with the container shutter holder 334. When the shutter side openings 332*d* and the holder side openings 334*d* facing each other reach the position positioned above the nozzle hole 610 as the container body 33 rotates, the toner scooped by the scooping portions 304 falls into the conveying nozzle 611 through the shutter side openings 332*d* and the holder side openings 334*d* as well as the nozzle hole 610.

It is to be noted that, as illustrated in FIG. 13(*c*), the opening direction Y1 in which the container shutter 332 rotates to open is opposite the rotation direction A in which the container shutter holder 334 rotates in accordance with the rotation of the container body 33 in the present embodiment. If the opening direction Y1 (rotation direction) is identical to the rotation direction A, a rotation force to close the container shutter 332 relative to the container shutter holder 334 acts while the container shutter holder 334 rotates. For example, it is assumed that the container shutter holder 334 is configured to rotate in the direction opposite the rotation direction A in FIG. 13(*c*). In this configuration, when the container shutter holder 334 rotates, the inertia force to keep the container shutter 332 stationary causes force to return the container shutter 332 in the direction opposite the opening direction Y1 in which the container shutter 332 rotates to open along the guides 334*e* and 334*f*.

In the state in which the conveying nozzle 611 is inserted in the container shutter 332, generally, the end of the conveying nozzle 611 is in contact with the nozzle end receiving portion 332*c* of the container shutter 332, and, for the container shutter 332 to rotate in the direction opposite the direction in which the container shutter 332 opens, force to push back the conveying nozzle 611 in the direction in which the conveying nozzle 611 is removed is necessary. Accordingly, it is difficult for the container shutter 332 to rotate in the opposite direction. However, in a case where the container shutter 332 is rotated in the direction opposite the opening direction Y1 due to some causes, it is possible that the shutter side openings 332*d* are deviated from the holder side openings 334*d* of the container shutter holder 334, inhibiting toner supply to the conveying nozzle 611.

In view of the foregoing, in the present embodiment, the opening direction Y1 in which the container shutter 332 rotates to open is made opposite the rotation direction A in which the container shutter holder 334 rotates, thereby preventing relative rotation of the container shutter 332 in the direction opposite the opening direction Y1. Thus, the container shutter 332 is kept open reliably.

Next, referring to FIGS. 16 through 17C, descriptions are given below of actions of the container shutter 332 in removal of the conveying nozzle 611 from the nozzle receiving portion 305 of the container shutter 332.

Figure 16:
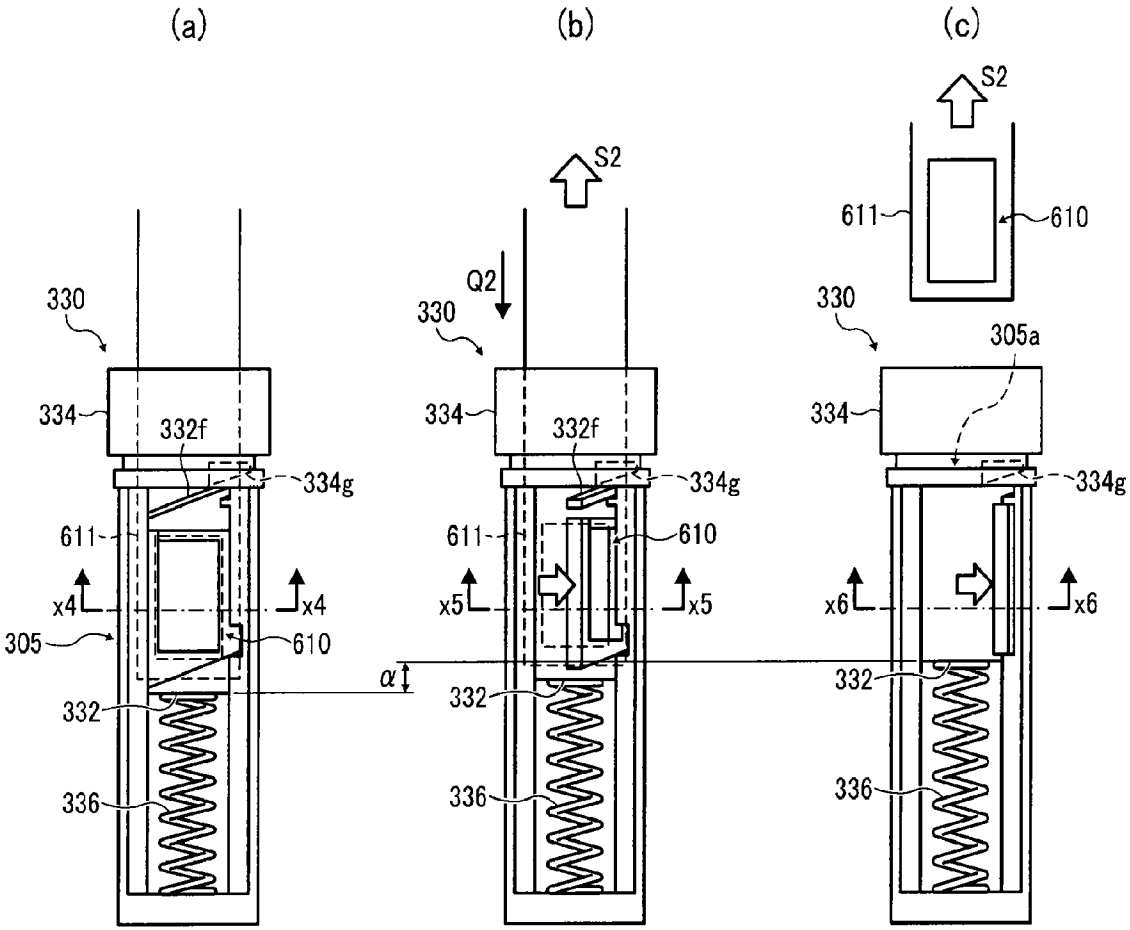
FIG. 16 illustrates rotation of the container shutter in accordance with removal of the conveying nozzle.
Figure 17A:
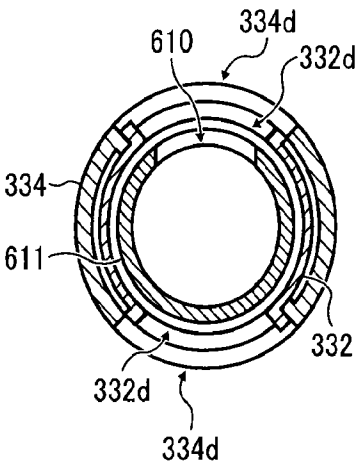
FIGS. 17A, 17B, and 17C are cross-sectional views corresponding to cross-sectional views (a), (b), and (c) in FIG. 16, respectively.
Figure 17B:
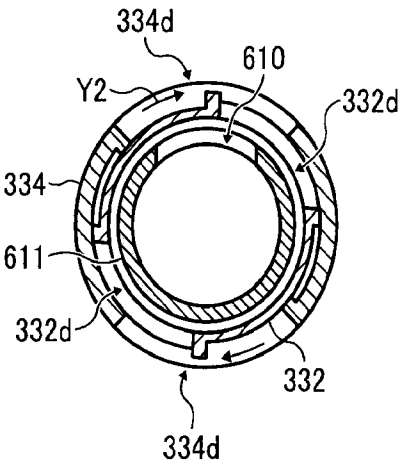
Figure 17C:
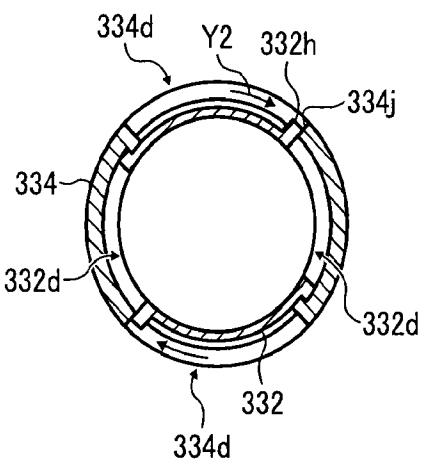

FIG. 16 illustrates the rotation of the container shutter 332 in accordance with the removal of the conveying nozzle 611, and FIGS. 17A, 17B, and 17C are cross-sectional views corresponding to cross-sectional views (a), (b), and (c) in FIG. 16, respectively. That is, FIGS. 17A, 17B, and 17C are cross-sectional views along lines x4-x4, x5-x5, and x6-x6 in the cross-sectional views (a), (b), and (c) in FIG. 16, respectively.

FIG. 16(*a*) illustrates a state in which the conveying nozzle 611 is fully inserted in the container shutter 332, that is, the toner container 32 is attached to the toner container 32. In this state, as illustrated in FIG. 17A, the shutter side openings 332*d* and the respective holder side openings 334*d* of the container shutter holder 334 face each other and are open. As the toner container 32 is moved in the detachment direction Q2 from this state, the conveying nozzle 611 moves in the direction indicated by arrow S2 (hereinafter "nozzle detachment direction S2") to be removed from the container shutter 332 as illustrated in FIG. 16(*b*). As the conveying nozzle 611 moves in the nozzle detachment direction S2, the container shutter 332 is pushed by the container shutter spring 336 in the nozzle detachment direction S2. At that time, the upper one in FIG. 16(*b*) of the guides 332*f* of the container shutter 332 starts rotating along the guide 334*g*, different from the guides 334*e* and 334*f* for insertion of the conveying nozzle 611, in the direction indicated by arrow Y2 in FIG. 17B. It is to be noted that the mechanism of rotation of the container shutter 332 at that time is similar to the above-described effect of the component Fa of the pressing force F (in FIG. 14) in insertion of the conveying nozzle 611, and detailed descriptions are omitted.

When the conveying nozzle 611 is further moved in the nozzle detachment direction S2 and removed from the container shutter 332 as illustrated in FIG. 16(*c*), the container shutter 332 stops rotating at the point of time when the shutter side openings 332*d* and the holder side openings 334*d* are closed with the wall face of the container shutter holder 334 and the wall face of the container shutter 332, respectively as illustrated in FIG. 17C. Specifically, as illustrated in FIG. 17C, as the projecting rim 332*h* of the shutter side openings 332*d* of the container shutter 332 comes into contact with a rim 334*j* of the shutter supporting portion 334*b*, which is different from the rim 334*i* by which the rim 332*h* is blocked in insertion of the conveying nozzle 611, the container shutter 332 is stopped rotating. In other words, the projecting rim 332*h* of the shutter side openings 332*d* of the container shutter 332, together with the rim 334*j* of the shutter supporting portion 334*b* of the container shutter holder 334, serves as a rotation restrictor that resists the biasing force of the container shutter spring 336 and inhibits the container shutter 332 from rotating relative to the container shutter holder 334 in the direction in which the container shutter 332 closes. Thus, the shutter side openings 332*d* and the holder side openings 334*d* are closed by the wall face of the container shutter holder 334 and that of the container shutter 332, respectively, and the holder side opening 334*d* of the container shutter holder 334 is closed.

As described above, in the present embodiment, the container shutter 332 is designed to rotate around the axis of the conveying nozzle 611 in accordance with insertion and removal of the conveying nozzle 611, thereby opening and closing the holder side opening 334*d* of the container shutter holder 334 (to connect and block the inside of the toner container 32 to and from the outside) with the small stroke a (in FIGS. 13 and 16) of the container shutter 332 in the nozzle detachment direction. Keeping the stroke a relatively small is advantageous in inhibiting the toner inside the container shutter holder 334 from being compressed by the container shutter 332 moving to the open position. Accordingly, even when the toner enters the clearance between the container shutter 332 and the container shutter holder 334, the toner is less likely to solidify in the clearance and hinder the movement of the container shutter 332. Thus, the present embodiment suppresses the toner compressed in the clearance between the container shutter 332 and the container shutter holder 334, thereby inhibiting malfunction of the container shutter 332 caused by the toner in the clearance. Accordingly, the holder side opening 334*d* of the container shutter holder 334 can be opened and closed reliably.

It is to be noted that, although both of the container shutter 332 and the container shutter holder 334 include spiral guides in the above-described embodiment, the shape of the guides is not limited to the spiral shape. For example, one of the container shutter 332 and the container shutter holder 334 includes the spiral guides, and the other has guide projections or guide grooves (not spiral-shaped) that slide along the spiral guides.

Figure 18:
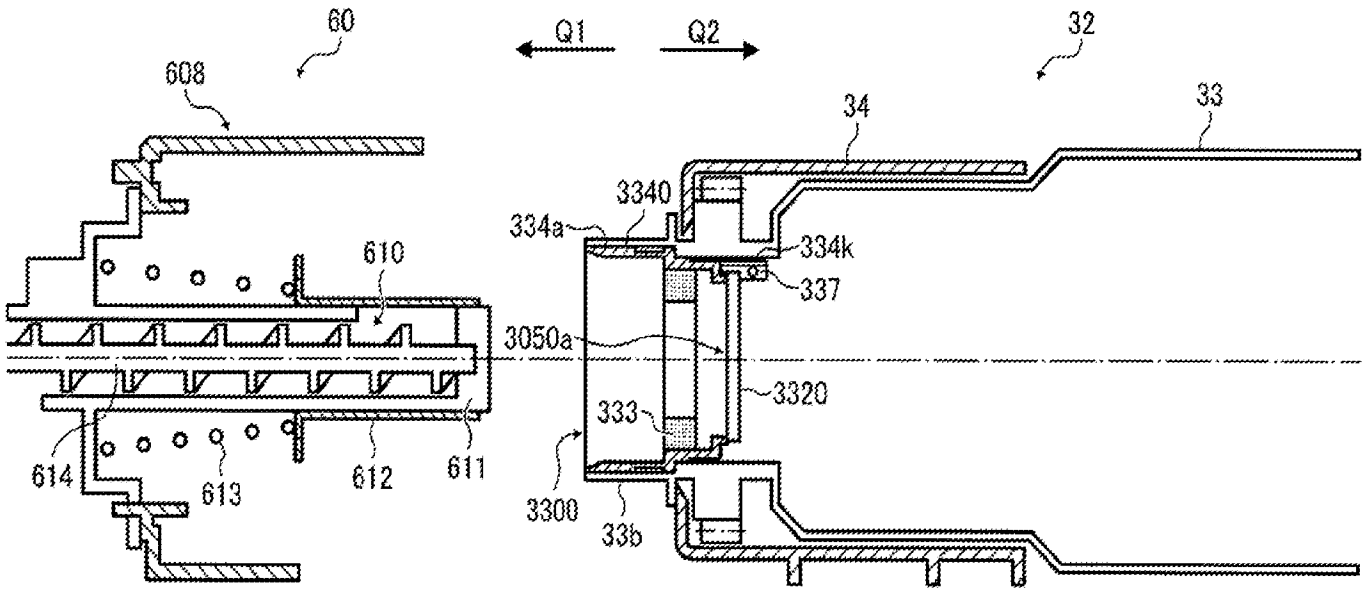
FIG. 18 is a schematic cross-sectional view illustrating a state in which a toner container is not mounted in a toner replenishing device according to another embodiment.
Figure 19:
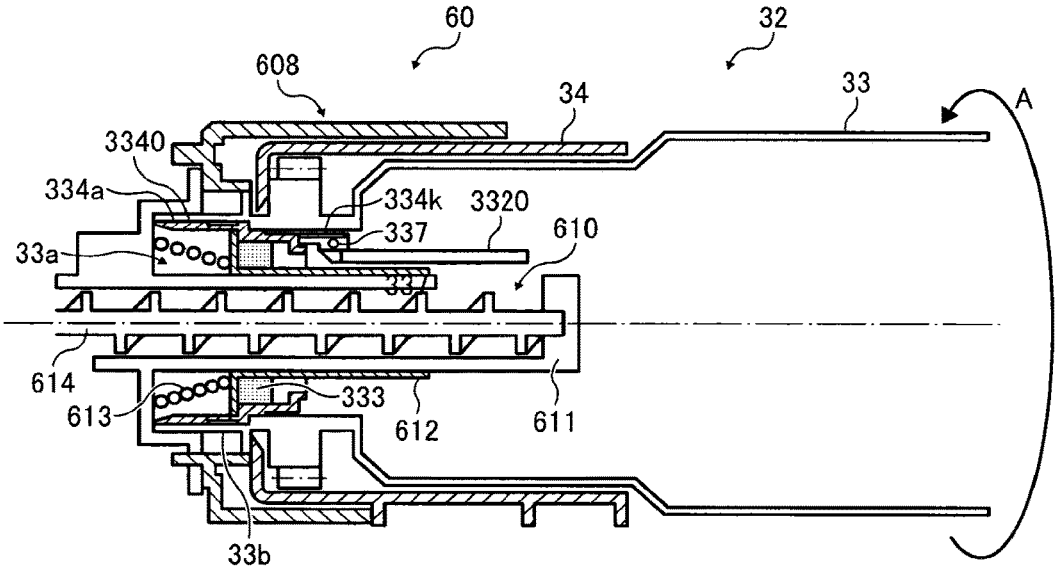
FIG. 19 is a schematic cross-sectional view illustrating a state in which the toner container is mounted in the toner replenishing device illustrated in FIG. 18.

FIGS. 18 and 19 are schematic cross-sectional views illustrating a toner container and a toner replenishing device according to a second embodiment. FIG. 18 illustrates a state in which the toner container 32 is not attached in the toner replenishing device 60, and FIG. 19 illustrates a state in which the toner container 32 is attached in the toner replenishing device 60. Descriptions are given below of the second embodiment, focusing on the differences from the above-described first embodiment.

In the embodiment illustrated in FIGS. 18 and 19, structures of a container shutter 3320 and a container shutter holder 3340 are different from the container shutter 332 and the container shutter holder 334 according to the first embodiment. Other than that, the structures according to the second embodiment are similar to those of the above-described embodiment. Specifically, in the configuration illustrated in FIGS. 18 and 19, the container shutter 3320 is configured to rotate around a support point 337 disposed at the rear end of the container shutter holder 3340 (front side in the detachment direction Q2).

Figure 20A:
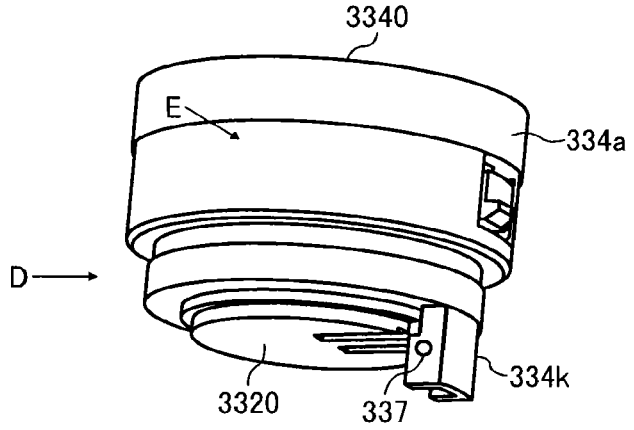
FIG. 20A is a perspective view of the container shutter and the container shutter holder illustrated in FIG. 18.
Figure 20B:
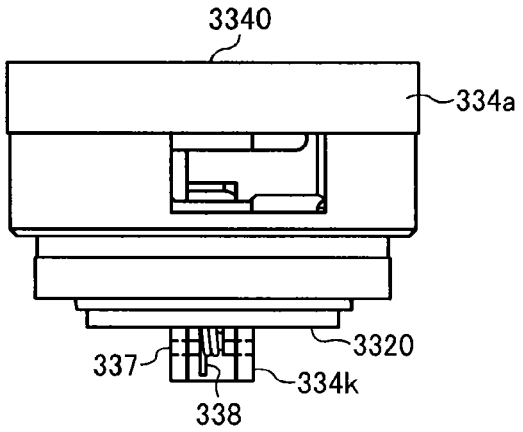
FIGS. 20B and 20C illustrate the container shutter and the container shutter holder as viewed in the direction indicated by arrow D and in the direction indicated by arrow E in FIG. 20A, respectively.
Figure 20C:
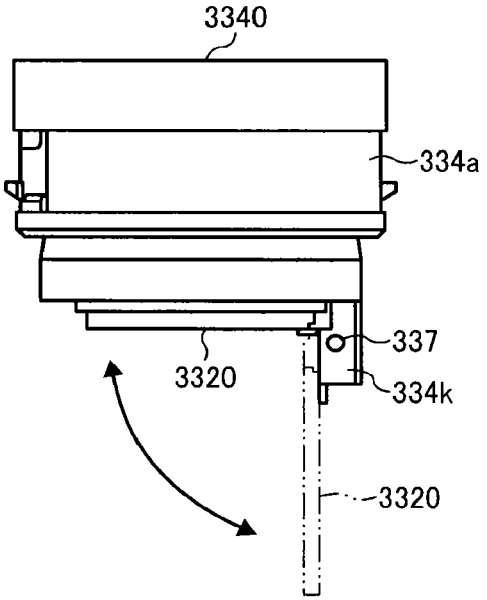

Referring to FIGS. 20A, 20B, and 20C, the container shutter 3320 and the container shutter holder 3340 according to the second embodiment are described in detail below. FIG. 20A is a perspective view of the container shutter 3320 and the container shutter holder 3340. FIGS. 20B and 20C illustrate the container shutter 3320 and the container shutter holder 3340 as viewed in the direction indicated by arrow D and in the direction indicated by arrow E in FIG. 20A, respectively.

As illustrated in FIG. 20A, the container shutter holder 3340 is cylindrical and open at both ends in the axial direction thereof, which are on the upper side and the bottom side in FIGS. 20A through 20C. Specifically, the container shutter holder 3340 includes the cylindrical attached portion 334*a* secured to the container opening 33*a* of the container body 33, and a shutter support 334*k* projecting from one end of the attached portion 334*a* in the axial direction of the attached portion 334*a*.

The container shutter 3320 is attached to the shutter support 334*k* rotatably via the support point 337. For example, the support point 337 is a shaft projecting from both sides of the container shutter 3320 in the width direction perpendicular to the direction in which the conveying nozzle 611 is inserted into the container opening 33*a*, and the shaft is rotatably fitted in engagement holes of the shutter support 334*k*. The container shutter 3320 rotates around the support point 337 to move between an open position, indicated by chain double-dashed lines in FIG. 20C, to open an opening at one end (bottom end in FIG. 20C) of the container shutter holder 3340 and a closed position, indicated by solid lines in FIG. 20C, to close the opening.

Additionally, as illustrated in FIG. 20C, a container shutter spring 338 to bias the container shutter 3320 to the closed position is attached to the shutter support 334*k*. In the present embodiment, for example, a torsion coil spring is used as the container shutter spring 338.

As illustrated in FIG. 18, the container shutter holder 3340 is attached to the container body 33, with the shutter support 334*k* facing the rear side of the container body 33 (front side in the attachment direction Q2) and the container shutter 3320 contained inside the container body 33. Further, as illustrated in FIG. 18, in the state in which the toner container 32 is disengaged from the toner replenishing device 60, the container shutter spring 338 biases and retains the container shutter 3320 at the closed position, and a nozzle insertion opening 3050*a* of the nozzle receiver 3300 is closed.

As illustrated in FIG. 19, as the toner container 32 is attached to the toner replenishing device 60, the end of the conveying nozzle 611 being inserted pushes the container shutter 3320, and the container shutter 3320 rotates around the support point 337 in the direction toward the open position. Accordingly, the nozzle insertion opening 3050*a* is open. Simultaneously with insertion of the conveying nozzle 611 into the container body 33, similar to the above-described first embodiment, the nozzle shutter 612 moves in the rear end side relative to the conveying nozzle 611, and the nozzle hole 610 is opened.

In this state, as the container body 33 rotates in the rotation direction A in FIG. 19, the toner inside the container body 33 is conveyed to the container front end by the spiral rib 302 and scooped above the conveying nozzle 611 by the scooping portions 304 that is rotating. Then, the scooped toner drops and enters the conveying nozzle 611 through the nozzle hole 610.

It is to be noted that, in the state illustrated in FIG. 19, although the container shutter 3320 at the open position overlaps the nozzle hole 610 from above, the container shutter holder 3340 and the container shutter 3320 rotate as the container body 33 rotates. Accordingly, the container shutter 3320 does not hinder the toner supply to the nozzle hole 610. That is, while the container shutter 3320 is not positioned above the nozzle hole 610, the scooped toner drops and enters the conveying nozzle 611 through the nozzle hole 610. The toner inside the conveying nozzle 611 is transported by the conveying screw 614 and supplied to the developing device 50 through the toner dropping passage 64.

When the toner container 32 is removed from the toner replenishing device 60 as illustrated in FIG. 18, the conveying nozzle 611 is removed from the container body 33, and the container shutter 3320 rotates to the closed position due to the biasing force exerted by the container shutter spring 338. Accordingly, the nozzle insertion opening 3050*a* is closed.

As described above, in the embodiment illustrated in FIGS. 18 through 19C, the container shutter 3320 is designed to rotate around the support point 337, to open the nozzle insertion opening, in accordance with insertion and removal of the conveying nozzle 611. This configuration enables the container shutter 3320 to reliably open and close. In other words, since the container shutter 3320 does not slide in the direction in which the conveying nozzle 611 is inserted, toner is inhibited from being compressed by the container shutter 3320 and entering the clearance between the container shutter 3320 and the container shutter holder 3340, thereby inhibiting malfunction of the container shutter 332 caused by the toner entering the clearance.

Numerous additional modifications and variations are possible in light of the above teachings. It is therefore to be understood that, within the scope of the appended claims, the disclosure of this patent specification may be practiced otherwise than as specifically described herein.

What is claimed is:

1. A powder container comprising:

a container body to contain a powder for use in image formation; and a nozzle receiver disposed on one longitudinal end side of the container body, the nozzle receiver including, a shutter having a nozzle insertion opening into which a conveying nozzle is inserted in a nozzle insertion direction, the conveying nozzle to convey the powder from an inside to an outside of the container body, and a shutter holder including an inclined face to guide the shutter to rotate around an axis of the conveying nozzle extending in the nozzle insertion direction and an opening to communicate with a nozzle opening of the conveying nozzle, wherein the shutter is to move between an open position to open the opening of the shutter holder and a closed position to close the opening of the shutter holder in accordance with insertion and removal of the conveying nozzle into the nozzle insertion opening.

2. The powder container according to claim 1, wherein the shutter holder includes a spiral guide having the inclined face, and wherein the shutter rotates along the spiral guide to move between the open position and the closed position.

3. The powder container according to claim 1, wherein the inclined face is inclined relative to the nozzle insertion direction such that a downstream side of the inclined face in the nozzle insertion direction approaches the open position, and wherein, as the shutter is pressed in the nozzle insertion direction by the conveying nozzle being inserted into the nozzle insertion opening, the inclined face guides the shutter to the open position.

4. The powder container according to claim 1, further comprising a biasing member to bias the shutter in a direction opposite the nozzle insertion direction, wherein, as the conveying nozzle is removed from the nozzle insertion opening, the biasing member causes the shutter to rotate from the open position to the closed position in a closing direction.

5. The powder container according to claim 4, wherein the shutter holder includes a rotation restrictor to resist a biasing force of the biasing member and restrict rotation of the shutter from the closed position further in the closing direction relative to the shutter holder.

6. The powder container according to claim 1, wherein the shutter holder rotates around the axis of the conveying nozzle, and wherein the inclined face is inclined relative to the nozzle insertion direction such that, when the shutter moves from the closed position to the open position, the shutter rotates in a direction opposite a direction in which the shutter holder rotates.

7. The powder container according to claim 6, wherein the shutter holder includes a rotation restrictor to restrict rotation of the shutter relative to the shutter holder while the shutter holder rotates in a state in which the shutter is at the open position.

8. The powder container according to claim 1, wherein the powder is toner.

9. The powder container according to claim 1, wherein the powder includes toner and carrier.

10. An image forming apparatus comprising the powder container according to claim 1.

11. An image forming apparatus comprising:

a container holding section to removably hold the powder container according to claim 1; and a powder conveying device including the conveying nozzle to fit in the nozzle insertion opening of the powder container.

12. A powder container comprising:

a container body to contain a powder for use in image formation; and a nozzle receiver disposed on one longitudinal end side of the container body, the nozzle receiver including, a shutter holder including a nozzle insertion opening into which a conveying nozzle is inserted, the conveying nozzle to convey the powder from an inside to an outside of the container body, and a shutter to close the nozzle insertion opening and secured to the shutter holder via a support point rotatably around the support point, wherein the shutter is to rotate between an open position to open the nozzle insertion opening and a closed position to close the nozzle insertion opening in accordance with insertion and removal of the conveying nozzle into the nozzle insertion opening.

13. The powder container according to claim 12, wherein the powder is toner.

14. The powder container according to claim 12, wherein the powder includes toner and carrier.

15. An image forming apparatus comprising the powder container according to claim 12.

16. An image forming apparatus comprising:

a container holding section to removably hold the powder container according to claim 12; and a powder conveying device including the conveying nozzle to fit in the nozzle insertion opening of the powder container.

* * * * *